US006945233B2

(12) United States Patent
Stewart et al.

(10) Patent No.: US 6,945,233 B2
(45) Date of Patent: Sep. 20, 2005

(54) SYSTEM AND METHOD OF OPTIMIZING FUEL INJECTION TIMING IN A LOCOMOTIVE ENGINE

(75) Inventors: Ted E. Stewart, Jacksonville, FL (US); David P. Miller, Ponte Vedra Beach, FL (US)

(73) Assignee: CSXT Intellectual Properties Corporation, Jacksonville, FL (US)

( * ) Notice: Subject to any disclaimer, the term of this patent is extended or adjusted under 35 U.S.C. 154(b) by 0 days.

(21) Appl. No.: 10/702,050

(22) Filed: Nov. 6, 2003

(65) Prior Publication Data

US 2004/0139948 A1 Jul. 22, 2004

Related U.S. Application Data

(63) Continuation-in-part of application No. 10/325,852, filed on Dec. 23, 2002, now Pat. No. 6,799,561.

(51) Int. Cl.[7] ..... F02M 37/04
(52) U.S. Cl. ..... 123/500; 123/478
(58) Field of Search ..... 123/500, 501, 123/503, 504, 495, 478; 417/494, 499, 289

(56) References Cited

U.S. PATENT DOCUMENTS

| | | | | |
|---|---|---|---|---|
| 3,566,849 | A | | 3/1971 | Frick |
| 3,567,346 | A | * | 3/1971 | Mekkes et al. |
| 4,327,694 | A | | 5/1982 | Henson et al. |
| 4,838,232 | A | | 6/1989 | Wich |
| 4,881,506 | A | * | 11/1989 | Hoecker ..... 123/503 |
| 4,886,640 | A | | 12/1989 | Garner, Jr. et al. |
| 5,033,442 | A | | 7/1991 | Perr et al. |
| 5,048,480 | A | | 9/1991 | Price |
| 5,097,812 | A | | 3/1992 | Augustin |
| 5,409,165 | A | | 4/1995 | Carroll, III et al. |
| 5,685,273 | A | | 11/1997 | Johnson et al. |
| 6,009,850 | A | | 1/2000 | DeLuca |
| 6,305,358 | B1 | | 10/2001 | Lukich |
| 6,321,723 | B1 | | 11/2001 | Merkle et al. |

FOREIGN PATENT DOCUMENTS

| | | |
|---|---|---|
| GB | 723982 | 2/1955 |
| GB | 1 431 747 | 4/1976 |
| JP | 62-17364 | 1/1987 |

OTHER PUBLICATIONS

International Search Report for Application No. PCT/US03/40690, dated Jun. 14, 2004.

Engine Maintenance Manuel, *Fuel System*, Section 11, pp. 11–1–11.11.

GE Instructions on Large Bendix Fuel–Oil Injection Pump GE Parts 132X1254–1, 132X1535 and 132X1715, pp. 1–16 (Feb. 1991).

Paul G. Burman and Frank Deluca, "Fuel Injection and Controls for Internal Combustion Engines," Simmons–Boardman Publishing Corporation, pp. 69 and 165, (1962). Exhibit #1 as Described in Attached IDS.

* cited by examiner

*Primary Examiner*—Mahmoud Gimie
(74) *Attorney, Agent, or Firm*—McGuireWoods LLP

(57) ABSTRACT

Systems and methods for reducing engine emissions in a locomotive are presented. In an embodiment, a fuel injector or a fuel injection pump of a fuel injection mechanism includes a plunger with an upper helix whose angle changes between points on the plunger that correspond to an idle throttle position and a full throttle position. As such, injection timing is optimized, and engine emissions are reduced.

4 Claims, 21 Drawing Sheets

SYSTEM AND METHOD OF OPTIMIZING FUEL INJECTION TIMING IN A LOCOMOTIVE ENGINE

CROSS-REFERENCE TO RELATED APPLICATIONS

This application is a continuation-in-part of U.S. patent application Ser. No. 10/325,852, filed on Dec. 23, 2002, now issued as U.S. Pat. No. 6,799,561, the entire contents of which are incorporated by reference.

BACKGROUND

1. Field

Embodiments of the present invention relate to systems and methods for reducing engine emissions in a diesel engine, such as a locomotive diesel engine.

2. Description of Related Art

Locomotive manufacturers and remanufacturers supply locomotive diesel engines to the rail transportation industry, which includes establishments furnishing transportation by line-haul railroad, as well as switching and terminal establishments. In recent years, Environmental Protection Agency (EPA) emissions standards for locomotive diesel engines have become increasingly demanding. In particular, standards enacted under the Federal Clean Air Act of 1998 require significant reductions of individual emission compounds, including oxides of nitrogen ($NO_x$) $NO_x$ gases, which include the compounds nitrogen oxide (NO) and nitrogen dioxide ($NO_2$), are a major component of smog and acid rain.

Exhaust from a locomotive diesel engine includes various gaseous-constituents, such as $NO_x$, carbon monoxide (CO), carbon dioxide ($CO_2$), and hydrocarbons (HC), as well as particulate matter. Severe environmental and economic consequences may ensue if locomotive engine emissions do not comply with applicable EPA standards.

U.S. Pat. No. 6,470,844 to Biess et al. discloses a system and method that automatically shuts down a primary engine of a locomotive after the primary engine has been idling for a predetermined period of time. A small secondary engine is started to perform useful functions on behalf of the shutdown primary engine. Because it reduces locomotive idle time, this approach reduces engine emissions. However, engine emissions remain a cause for concern when the primary engine is running.

Therefore, what is needed is a system and method for reducing engine emissions in a locomotive.

DETAILED DESCRIPTION

Systems and methods for an engine, such as a diesel engine in a locomotive, are presented. In various embodiments, a fuel injection mechanism includes a fuel injector (unit injector) or fuel injection pump. The fuel injector or fuel injection pump includes a plunger with an upper helix whose angle changes between points on the plunger that correspond to an idle throttle position and a full throttle position. As such, injection timing is optimized, and engine emissions are reduced.

In other embodiments, the fuel injection mechanism employs a nozzle tip formed of a chromium hot-work steel. Accordingly, reductions in engine emissions may be sustained over long periods of time.

Figure 1:
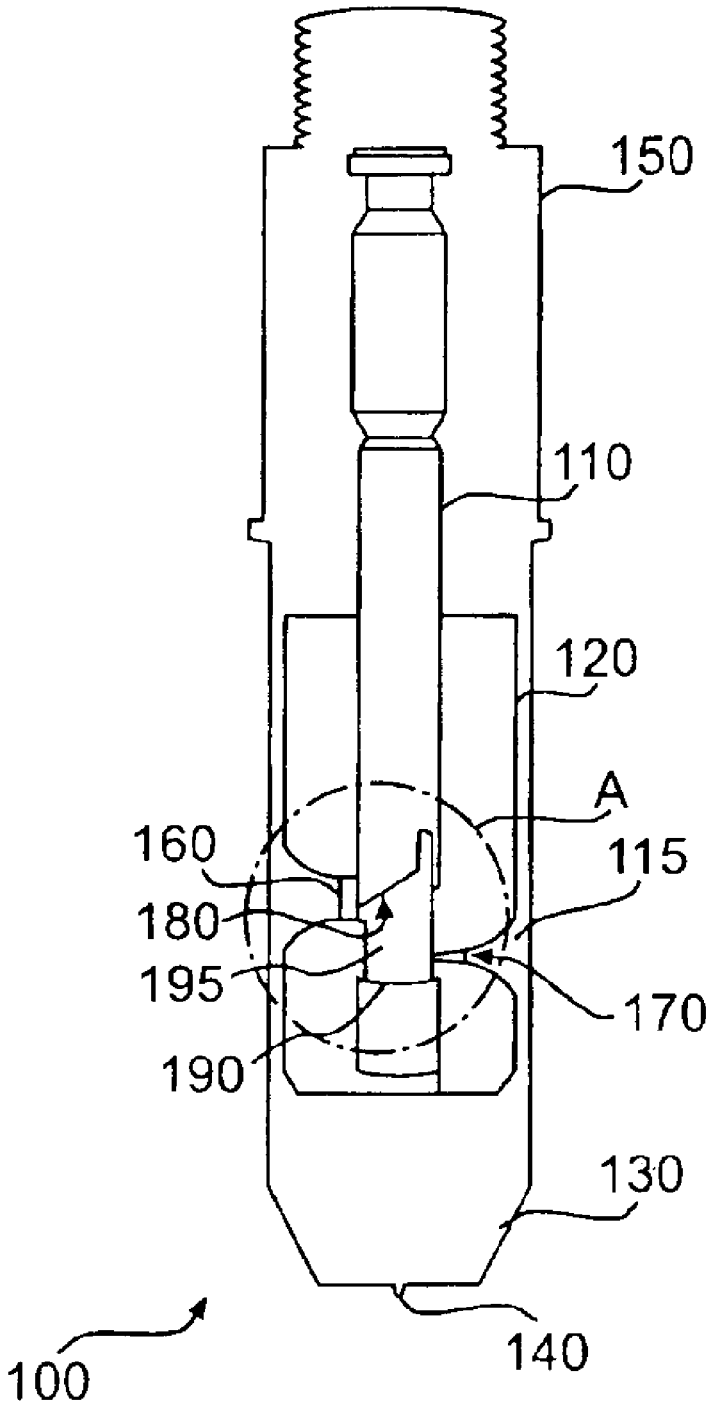
FIG. 1 is a partially broken away cross-sectional view of a fuel injector according to an embodiment of the present invention.

FIG. 1 is a partially broken away cross-sectional view of a fuel injector 100 according to an embodiment of the present invention. In various embodiments, injector 100 may be a unit injector for a fuel system of an engine, such as a diesel engine manufactured by GM EMD (General Motors Electro-motive Division). EMD-type engines employ mechanical control of injection timing and may be implemented effectively in various settings, such as, for example, locomotive (line-haul, switcher, passenger, or road), marine propulsion, offshore- and land-based oil well drilling rigs, stationary electric power generation, nuclear power generating plants, and pipeline and dredge pump applications. In one embodiment, injector 100 is implemented in an EMD 567, 645, or 710 series engine.

For exemplary purposes, drawings herein depict a unit injector and associated plungers for EMD-type engines. However, it is to be understood that teachings herein may be similarly applied to engines that employ fuel injection pumps, such as diesel engines manufactured by GE Transportation Systems, including the GE 7FDL and 7HDL engines, and diesel engines manufactured by ALCO. In such engines, each fuel injection pump includes a plunger that supplies fuel to an injector via a high pressure fuel line. Helices of such plungers may be modified consistent with principles presented herein. A nozzle tip as described herein also may be utilized.

Fuel injector 100 includes a body 150, a plunger 110, a housing nut 115, a bushing 120, a nozzle tip 130, and spray holes 140. Other components of injector 100 are not shown in FIG. 1 and are known in the art. Injector 100 is located and seated in a hole of a cylinder head of an engine fuel system.

In an embodiment, nozzle tip 130 of injector 100 may be formed of a chromium hot-work steel. The steel may be substantially through-hardened, and may conform, for example, to the H11 specification of the American Iron and Steel Institute (AISI) or the T20811 specification of the Unified Numbering System (UNS). As such, nozzle tip 130 may create effective atomization for longer periods of time, without deterioration of spray holes 140. Accordingly, injector 100 may have an extended life of use in an injection system.

Plunger 110 slidably fits within bushing 120. Bushing 120 includes an upper port 160 and a lower port 170. Upper port 160 and lower port 170 are pathways for fuel. The amount of fuel injected into a cylinder depends on the extent to which the ports are closed, as described below.

The specific form of plunger 110, including diameter, roundness, and straightness thereof, may vary depending on the implementation. Diameters of plungers may vary depending on the amount of fuel that is needed for injection. In an exemplary implementation, plunger 110 may have a diameter of between about 8 and 22 mm. Materials for plunger 110 may be chosen to prevent plunger 110 from substantially wearing down over time, and thus to prevent performance of plunger 110 from being degraded. Plunger 110 may be formed, for example, of bearing quality or high alloy steel, such as a chromium/nickel alloy. For example, the steel may conform to the 51501 or 52100 specifications of the Society of Automotive Engineers (SAE). Use of appropriate metals may ensure that helices described below maintain their shape for longer periods of time.

Plunger 110 includes an upper helix 180 and a lower helix 190. Upper helix 180 and lower helix 190 determine the opening and closing of upper port 160 and lower port 170 of bushing 120. Upper helix 180 determines when injection starts, and; lower helix 190 determines when injection ends. As such, the helices determine the volume of fuel that is injected.

Figures 1B, 1C, 1D, 1E, 1F:
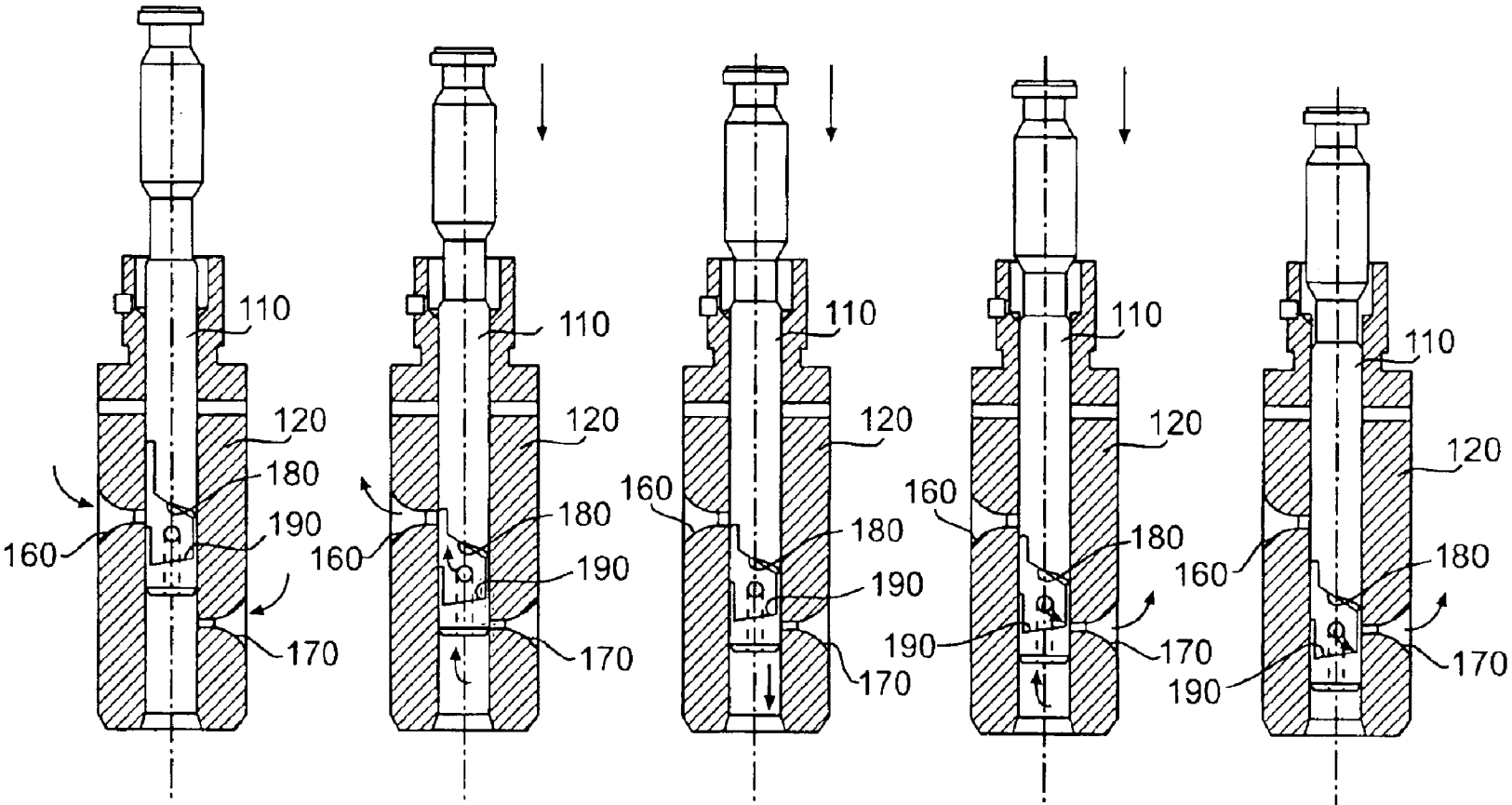
FIGS. 1B, 1C, 1D, 1E, and 1F illustrate a complete stroke of a fuel injector plunger for a switcher-type engine.

For example, FIGS. 1B–1F illustrate a complete stroke of the plunger 110 with respect to bushing 120 for a switcher-type engine. At the top of the stroke, the upper and lower ports 160, 170 open to admit fuel as shown in FIG. 1B. As plunger stroke begins, fuel escapes through the upper port 160 as shown in FIG. 1C. As shown in FIG. 1D, as both the upper and lower ports 160, 170 are closed by the plunger 110, the high pressure created forces fuel into the cylinder. Injection ends as the lower port 170 opens to allow fuel below the plunger 110 to escape, as shown in FIG. 1E. FIG. 1F illustrates the bottom of the stroke at which the lower port 170 is fully open.

Upper helix 180 and lower helix 190 include ridges that define a shallow fuel channel 195 encircling an axial portion of plunger 110. Upper helix 180 and lower helix 190 may be formed in various ways. In some embodiments, upper helix 180 and/or lower helix 190 are formed as a part of a machining operation that produces plunger 110. In other embodiments, an existing plunger is modified by a selective machining operation to produce upper helix 180 and/or lower helix 190.

In particular, upper helix 180 includes a ridge portion that slopes from a first point on the plunger surface towards a second point on the plunger surface. Sloping may involve one or more instances of ascending, descending, or neither ascending nor descending, between the first and second points. In some embodiments, the first point may be associated with an idle throttle position of injector 100, and the second point may be associated with a full throttle position of injector 100. Changes in slope of the ridge portion imply that the ridge portion may include multiple segments of predetermined length and/or height. In some embodiments, changes in slope may occur gradually such that one or more portions of the ridge portion are curved in perspective; for such embodiments, segments of the ridge portion may be extremely short. In other embodiments, changes in slope may be abrupt such that the ridge portion appears to have one or more clearly distinct portions.

Plunger 110 may be given a constant stroke reciprocating motion by an injector cam acting through a rocker arm and plunger follower (not shown). Timing of the injection period during the plunger stroke may be set by an adjusting screw at the end of the rocker arm.

Figure 1I:
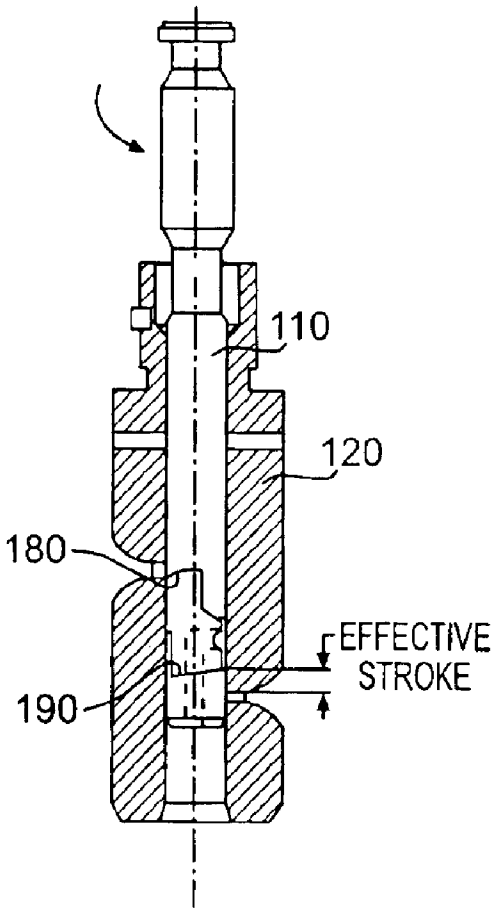
FIGS. 1G, 1H, and 1I illustrate plunger rotation at an idle throttle position, a half throttle position, and a full throttle position for a switcher-type engine.
Figure 1H:
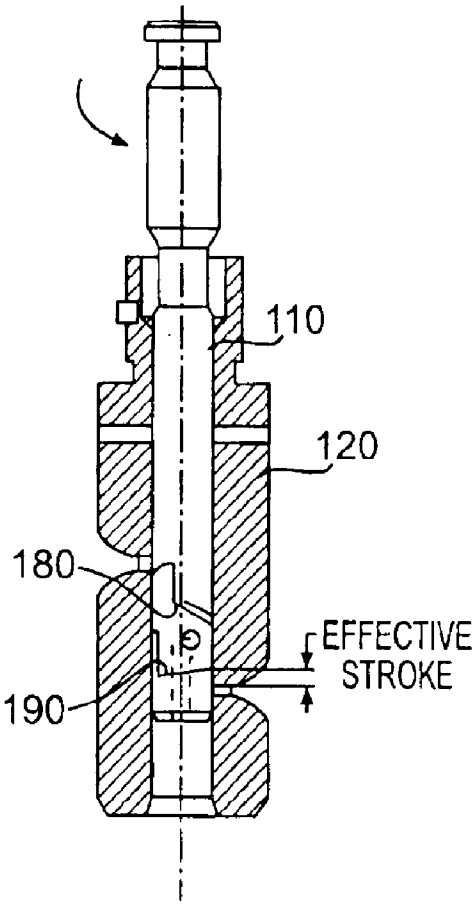
Figure 1G:
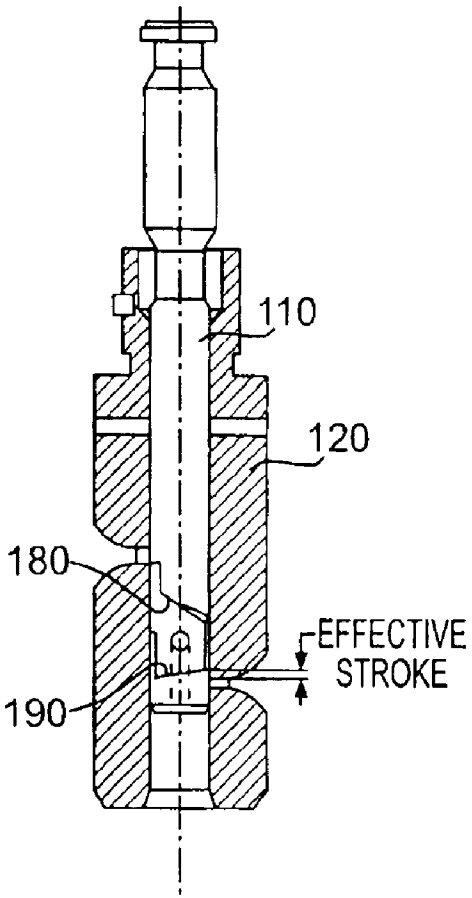

Plunger 110 may be rotated via a rack and gear (not shown), as known in the art. Rotation of plunger 110 regulates the time that upper port 160 and lower port 170 may open and close during the downward stroke, thus determining the quantity of fuel injected into the cylinder. As plunger 110 is rotated from idle throttle position to full throttle position, the pumping part of the stroke is lengthened, injection is started earlier, and more fuel is injected. For example, FIGS. 1G–1I illustrate plunger rotation at an idle position, a half throttle position (half load), and a full throttle position (full load) for a switcher-type engine. As illustrated, the effective stroke of the plunger is lengthened from idle to full load.

Proper atomization of fuel is accomplished by the high pressure created during the downward stroke of plunger 110, which forces fuel past a needle valve (not shown), causing the needle valve to lift, thus forcing fuel out through spray holes 140 in nozzle tip 130 of injector 100.

A "helix angle" of a helix is the angle between a tangent to the helix and a line perpendicular to the internal axis of the helix and intersecting the tangent point. Changes in helix angle generally correspond to changes in the observed slope of a helix of a plunger. That is, when the helix angle changes, one may observe a change in slope (also called "lead") of the helix. For embodiments herein, for ease of explanation, a plunger is described as having one helix with multiple helix angles (i.e., multiple slopes or leads). However, it is to be understood that the upper helix of a plunger herein actually has one or more portions of respective helices that have associated helix angles.

According to various embodiments of the present invention, plunger 110 has an upper helix whose helix angle changes at least once from a first point on plunger 110 which corresponds to an idle throttle position to a second point on plunger 110 which corresponds to a full throttle position. As such, injection timing of injector 100 may be optimized as plunger 110 is rotated within bushing 120.

In some embodiments, the helix angle changes such as to advance injection timing. Alternatively or additionally, the helix angle changes such as to retard, or neither advance nor retard, injection timing. By optimizing injection timing, emissions and combustion efficiency may be improved for an engine.

In an EMD-type unit injector, degrees of rotation of plunger 110 within bushing 120 may be associated with predetermined discrete throttle positions. Table 1 list exemplary associations that be implemented in a diesel-electric locomotive. Plunger 110 in Table 1 diameter ranging from about 0.420 to 0.422 inches, for example.

TABLE 1

Degrees of Rotation and Throttle Positions

| Degree of Rotation of Plunger 110 | Throttle Position |
|---|---|
| 0° | Idle |
| 25° | Notch 1 |
| 50° | Notch 2 |
| 75° | Notch 3 |
| 100° | Notch 4 |
| 125° | Notch 5 |
| 150° | Notch 6 |
| 175° | Notch 7 |
| 200° | Notch 8 |

As Table 1 illustrates, adjacent throttle positions are uniformly separated by 25°. For instance, when a locomotive engineer moves a throttle selector from notch 4 to notch 5, the plunger 110 is rotated 25° within bushing 120. Similarly, when the throttle selector is moved from notch 5 to notch 6, plunger 110 is rotated another 25°.

It is to be appreciated that Table 1 represents an exemplary division into discrete throttle position, and that 25° is an exemplary division. In other engine implementations, there may be more or fewer discrete throttle positions, and/or the division between discrete throttle positions need not be uniform. Moreover, in some embodiments, such as, for example, marine and stationary power embodiments, there may not be discrete throttle positions. For example, the operating of a lever may gradually and continuously increase or decrease the throttle, i.e., rotate a plunger within a bushing.

According to some embodiments of the present invention, helix angles on a plunger, and point(s) on the plunger at which transitions in helix angle occur are selected based on emissions data and/or empirical engine performance testing. For example, weighted emissions duty cycles or other relevant data may be studied. If, for example, it is demonstrated that emission levels are problematic for an engine running in idle, notch 1, and notch 2, then the upper helix of a plunger may have different helix angles at points on the plunger, such as points corresponding to those throttle settings, in order to retard or advance injection timing. The form of lower helix 190 also may be varied, which may impact upon the injection process.

Moreover, the effects of varying helix angles, which may be engine-and implementation-specific, may be studied to determine optimal helix angles and transition points on a plunger for throttle settings ranging from full to idle. Exemplary criteria for evaluating implementations may include emissions levels and combustion efficiency. In various embodiments, helix angles and transition points may be chosen to ensure compliance with regulatory emissions limits, while minimizing fuel penalties associated with compliance.

Figure 2C:
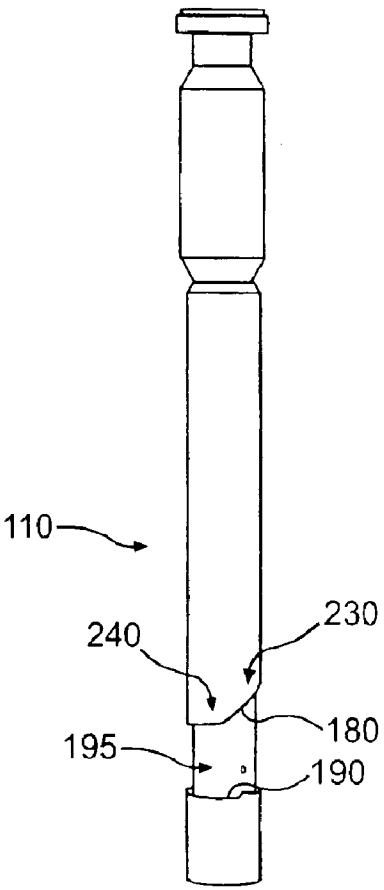
FIGS. 2A, 2B, and 2C illustrate a fuel injector plunger in various exemplary degrees of rotation according to an embodiment of the present invention.
Figure 2B:
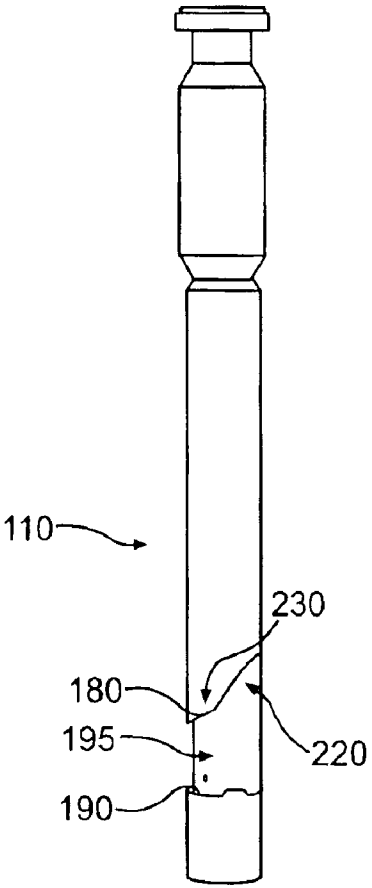
Figure 2A:
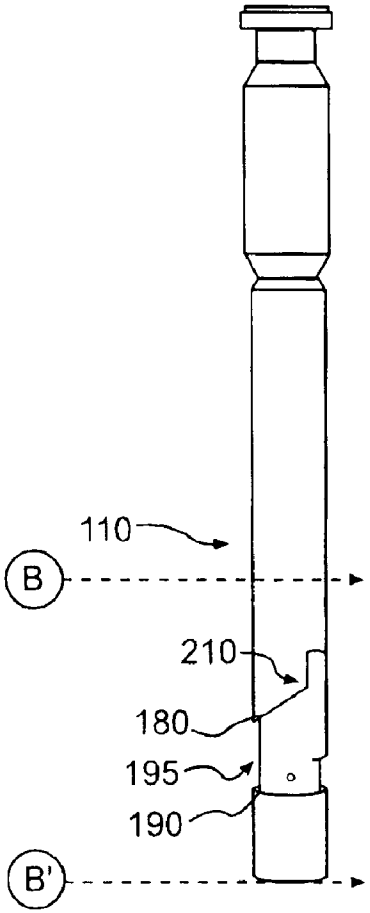

FIGS. 2A, 2B, and 2C illustrate plunger 110 in various degrees of rotation according to an embodiment of the present invention. Upper helix 180 generally slopes from a point 210 corresponding to an idle throttle position (FIG. 2A) to a point 240 corresponding to a notch 8 throttle position (FIG. 2C).

More particularly, FIG. 2A shows that upper helix 180 generally slopes downward from point 210. FIG. 2B shows a change in slope (helix angle) of upper helix 180 at a point 220 corresponding to a notch 5 throttle position, and another change in slope (helix angle) at a point 230 corresponding to a notch 6 throttle position. Finally, FIG. 2C shows upper helix 180 slope to a point 240 corresponding to a notch 8 throttle position.

It is to be appreciated that FIGS. 2A, 2B, and 2C are merely illustrative of an exemplary plunger 110 according to an embodiment of the present invention. The precise form of upper helix 180, including the number of transitions in slope (helix angle), and the points on plunger 110 at which transitions occur, as well as the angular measurements of each helix angle, may vary depending on the implementation.

Figure 3A:
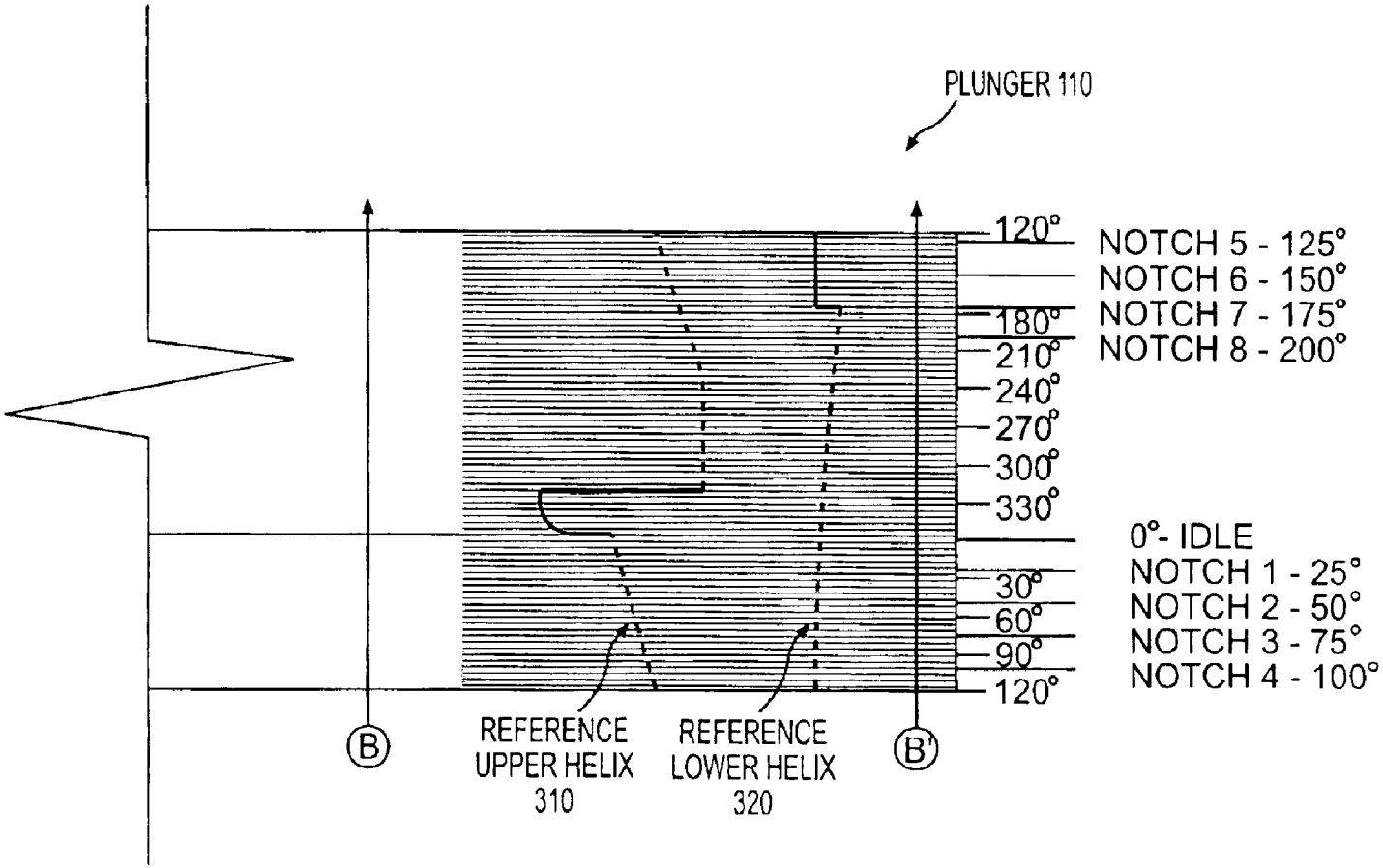
FIGS. 3A, 3B, and 3C illustrate exemplary planar views of an axial portion of a plunger according to embodiments of the present invention.
Figure 3B:
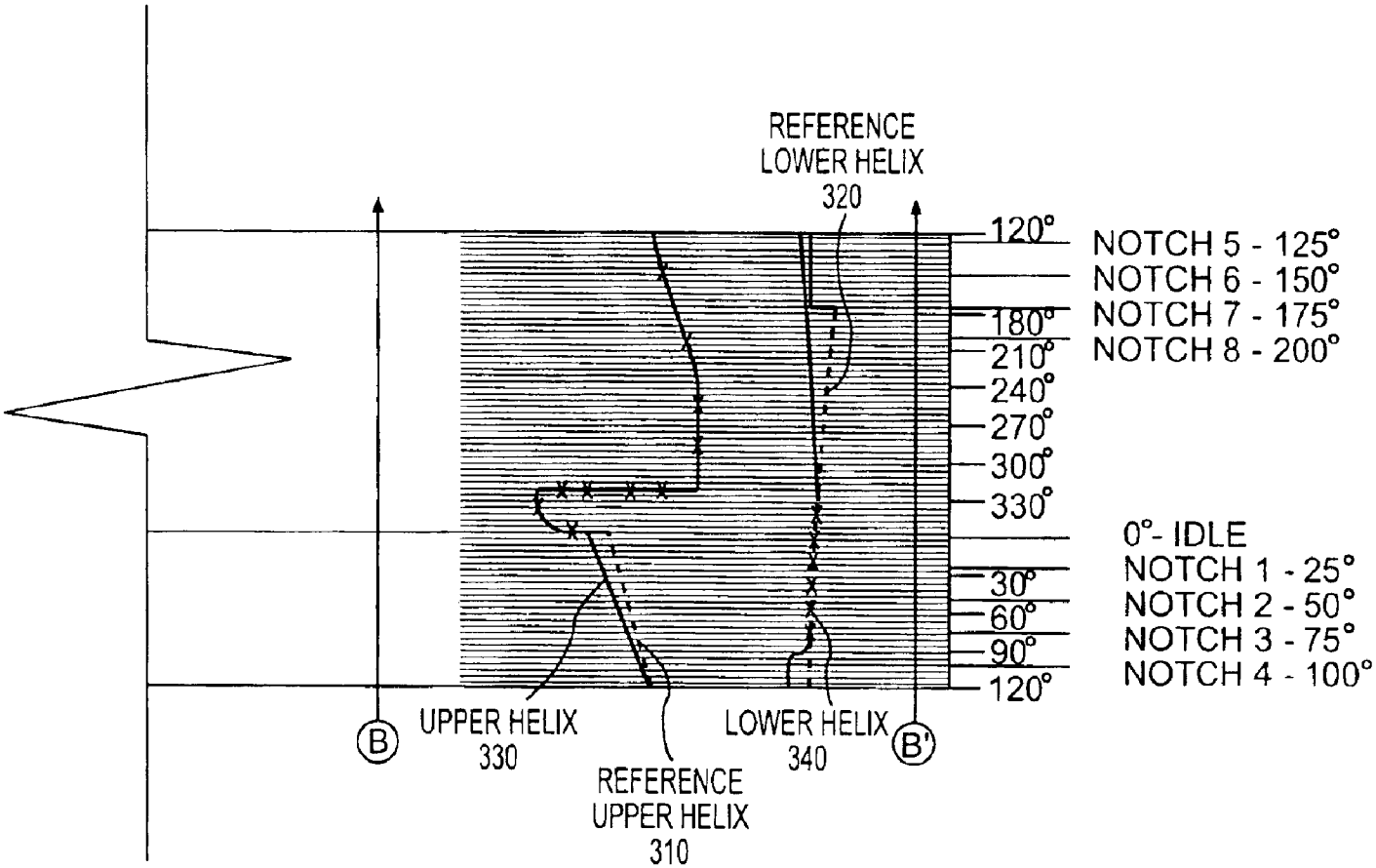
Figure 3C:
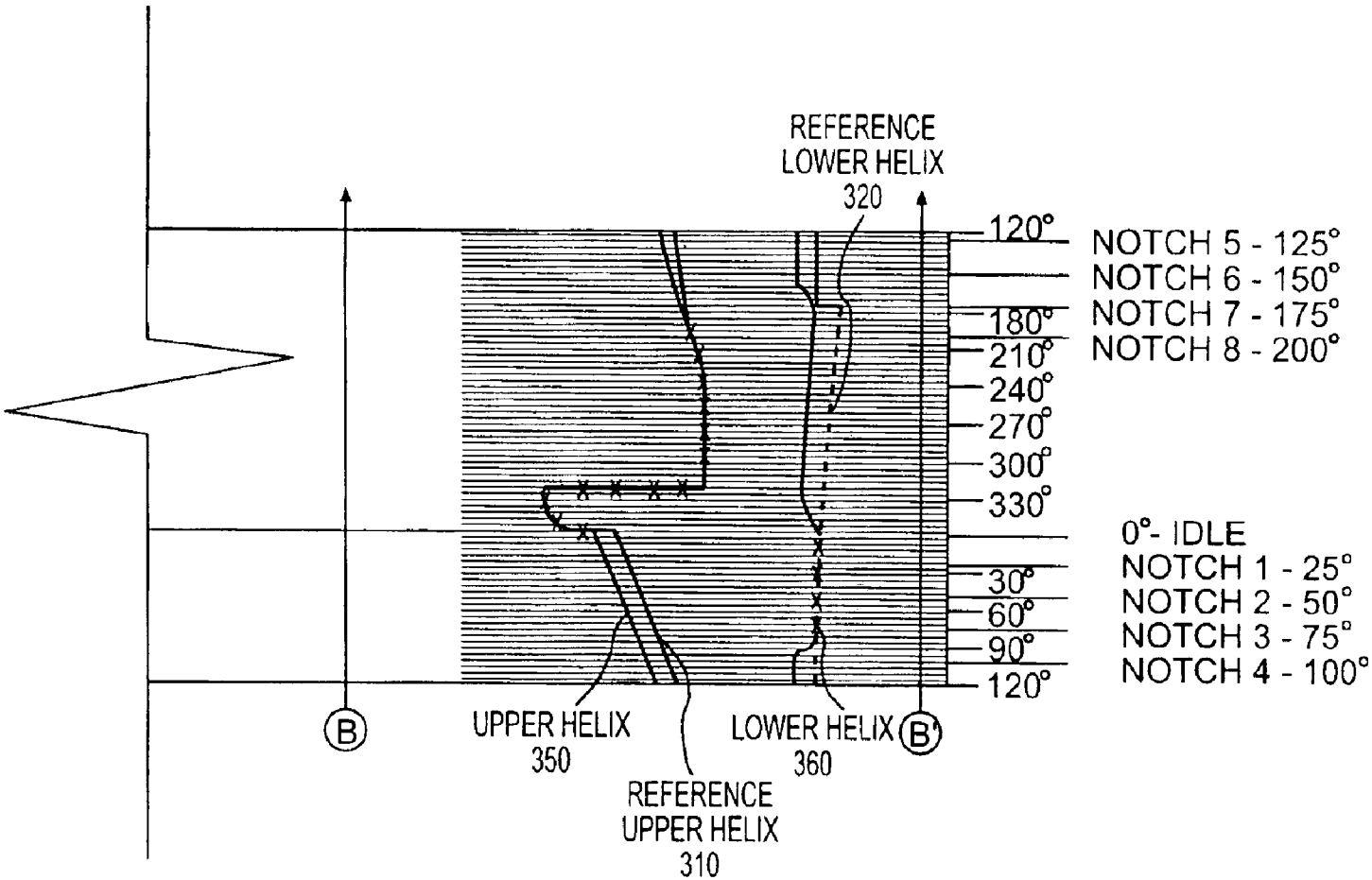

FIGS. 3A, 3B, and 3C illustrate planar views of an axial portion of plunger 110 between lines B and B' of FIG. 2A according to embodiments of the present invention. Upper and lower helices are shown in each figure. Parallel lines identify points along the upper helix that correspond to particular throttle settings.

FIG. 3A shows a reference upper helix 310 and a reference lower helix 320. Reference upper helix 310 has a helix angle that does not substantially change from idle (0°) to notch 8 (200°). As seen in FIG. 3A, the slope of reference upper helix 310 is substantially constant from idle to notch 8.

FIG. 3B shows an exemplary upper helix 330 and lower helix 340 according to an embodiment of the present invention. For purposes of comparison, reference upper helix 310 and reference lower helix 320 of FIG. 3A are shown in dashed lines in FIG. 3B. Portions of upper helix 330 that coincide with reference upper helix 310 are indicated with x's. Coinciding portions of lower helix 340 and reference lower helix 320 are similarly indicated.

Upper helix 330 has associated helix angles that change from idle to notch 8. Specifically, from idle to notch 6, upper helix 330 has an associated slope (helix angle). From notch 6 to notch 8, upper helix 330 has a different slope (helix angle).

More particularly, from idle to notch 6, the helix angle of upper helix 330 is greater than that of reference upper helix 310. That is, between the parallel lines corresponding to idle and notch 6 in FIG. 3B, the slope of upper helix 330 (with respect to a line perpendicular to the internal axis of the helix) is greater than the slope of reference upper helix 310. At idle, upper helix 330 is displaced towards a top of plunger 110 (away from reference lower helix 320) as compared with reference upper helix 310. From notches 6 to 8, the helix angle of upper helix 330 is substantially the same as that of reference upper helix 310. That is, between the parallel lines corresponding to notch 6 and notch 8, the slope of upper helix 330 and that of reference upper helix 310 are substantially the same, and the respective helices are coincident.

Accordingly, the exemplary design of upper helix 330 of FIG. 3B retards injection timing for idle to notch 6 relative to a design incorporating reference upper helix 310. Such retarding may improve emissions for an engine whose fuel injection system includes plunger 110.

FIG. 3C shows an exemplary upper helix 350 and lower helix 360 according to an embodiment of the present invention. For purposes of comparison, reference upper helix 310 and reference lower helix 320 of FIG. 3A are shown in dashed lines in FIG. 3C. Portions of upper helix 350 that coincide with reference upper helix 310 are indicated with x's. Coinciding portions of lower helix 360 and reference lower helix 320 are similarly indicated.

Upper helix 350 has associated helix angles that change from idle to notch 8. Specifically, from idle to notch 5, upper helix 350 has an associated slope (helix angle). From notch 5 to notch 7, upper helix 350 has a different slope (helix angle). From notch 7 to notch 8, upper helix 350 has yet a different slope (helix angle).

More particularly, from idle to notch 5, upper helix 350 is displaced towards a top of plunger 110 (away from reference lower helix 320) as compared with reference upper helix 310. Between the parallel lines corresponding to idle and notch 5 in FIG. 3C, the slope of upper helix 350 is substantially the same as the slope of reference upper helix 310. From notches 5 to 7, the helix angle of upper helix 330 is greater than that of reference upper helix 310. That is, between the parallel lines corresponding to notch 5 and notch 7, the slope of upper helix 350 is greater than that of reference upper helix 310.

From notches 7 to 8, the helix angle of upper helix 330 is substantially the same as that of reference upper helix 310. That is, between the parallel lines corresponding to notch 7 and notch 8, the slope of upper helix 350 and that of reference upper helix 310 are substantially the same, and the respective helices are coincident.

Accordingly, the exemplary design of upper helix 350 of FIG. 3C retards injection timing for idle to notch 7 relative to a design incorporating reference upper helix 310. Such retarding may improve emissions for an engine whose fuel injection system includes plunger 110.

Figure 4:
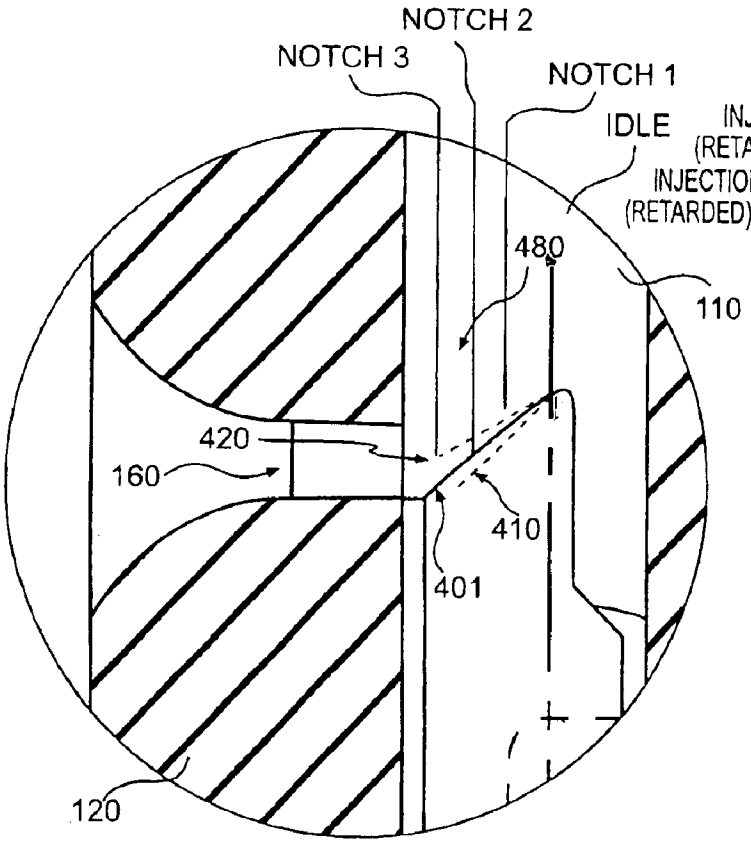
FIG. 4 illustrates a selected portion of a plunger according to an embodiment of the present invention.

FIG. 4 illustrates a selected portion of plunger 110 according to another embodiment of the present invention. The portion shown corresponds to portion A identified in FIG. 1. Upper helix 480 is generally shown in FIG. 4. Parallel lines identify points a long upper helix 480 that correspond to particular throttle settings. Although only portions of upper helix 480 corresponding to idle, notch 1, notch 2, and notch 3 throttle settings are shown, teachings herein may be applied for other throttle settings.

A reference helix 401 is shown for purposes of comparison. Reference helix 401 has an associated helix angle (slope) that does not change between an idle and notch 3 throttle setting.

Exemplary helices 420 and 410 are also shown in FIG. 4. Helix 420 has a helix angle less than that of reference helix 401. As such, helix 420 may retard injection timing for idle, notch 1, notch 2, and notch 3 settings as compared to a plunger that includes reference helix 401. Alternatively, helix 410 has a helix angle greater than that of reference helix 401. As such, helix 410 may advance injection timing for idle, notch 1, notch 2, and notch 3 settings as compared to a plunger that includes reference helix 401.

Figure 5:
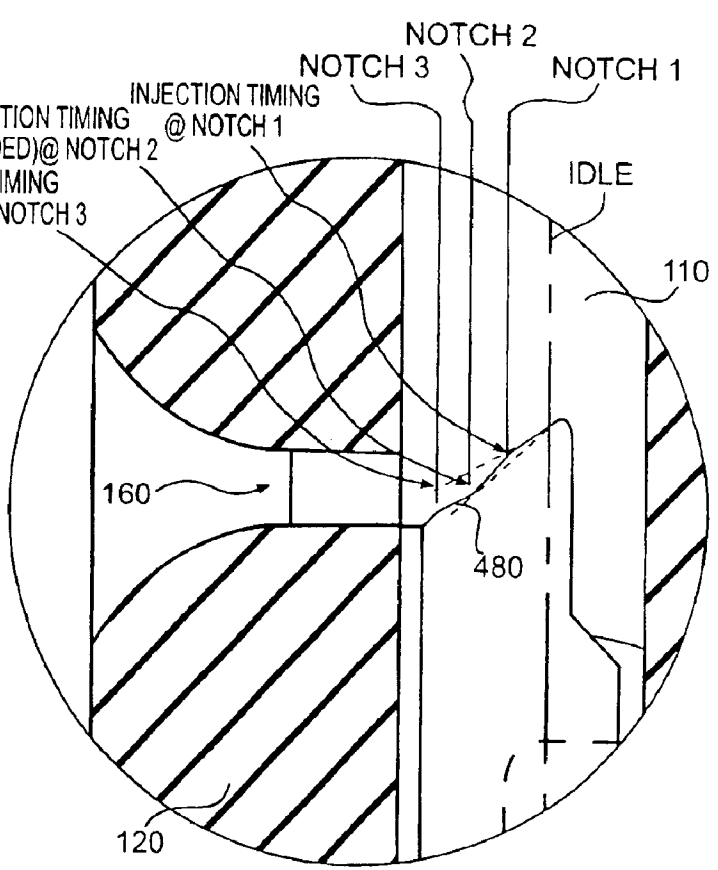
FIG. 5 illustrates a selected portion of a plunger according to an embodiment of the present invention.

FIG. 5 illustrates a selected portion of plunger 110 according to another embodiment of the present invention. The portion shown corresponds to portion A identified in FIG. 1. Upper helix 580 is shown in FIG. 5. Parallel lines identify points along upper helix 580 that correspond to particular throttle settings. Although only portions of upper helix 580 corresponding to idle, notch 1, notch 2, and notch 3 throttle settings are shown, teachings herein may be applied for other throttle settings.

Upper helix 580 has three associated helix angles (slopes) between idle and notch 3 settings. In particular, upper helix 580 has a first helix angle (slope) between the idle and notch 1 positions. At notch 1, the helix angle increases—the illustrated slope becomes steeper—and injection timing is thus advanced. At notch 2, the helix angle decreases—the illustrated slope becomes less steep—and injection timing is thus retarded. At notch 3, the helix angle conforms to a helix angle of a reference helix (not shown), and timing is neither advanced nor retarded relative to the reference helix.

In various engines, helix timing changes may be complementary to flywheel timing changes. Accordingly, in some embodiments, both the design of an upper helix and flywheel timing adjustments may be employed to optimize injection timing. In an exemplary embodiment, helix angles for upper helix 580 of FIG. 5 may be chosen such that, exclusive of flywheel timing adjustments, injection timing is altered by about −2° relative to a reference helix (not shown) at notch 1; +2° at notch 2; and 0° at notch 3. Further optimization of injection timing may be achieved by adjusting flywheel timing.

In an embodiment similar to FIG. 3B above, upper helix 330 may be modified such that, (1) from idle to notch 5, the helix angle of upper helix 330 is greater than that of reference upper helix 310, and at idle, upper helix 330 is displaced towards a top of plunger 110; and (2) from notches 5 to 8, the helix angle of upper helix 330 is substantially the same as that of reference upper helix 310, and those helices are coincident. Exemplary injection timing for such a modified injector is shown in Table 2. For purposes of comparison, timing values for an injector with reference upper helix 310 are also shown.

TABLE 2

Exemplary Injection Timings

| Throttle Position | Injection Timing of Reference Injector with Reference Upper Helix 310 | Injection Timing of Injector with Upper Helix 330 (as modified) | Difference |
|---|---|---|---|
| Notch 8 | 19° BTDC (Before Top Dead Center) | 19° BTDC | 0° |
| Notch 7 | 17° BTDC | 17° BTDC | 0° |
| Notch 6 | 15° BTDC | 15° BTDC | 0° |
| Notch 5 | 14° BTDC | 13° BTDC | −1° |
| Notch 4 | 13° BTDC | 11° BTDC | −2° |
| Notch 3 | 9° BTDC | 6.5° BTDC | −2.5° |
| Notch 2 | 7° BTDC | 4.5° BTDC | −2.5° |
| Notch 1 | 5° BTDC | 1.5° BTDC | −3.5° |
| Idle | 4° BTDC | 0.5° ATDC (After Top Dead Center) | −4.5° |

Figure 6B:
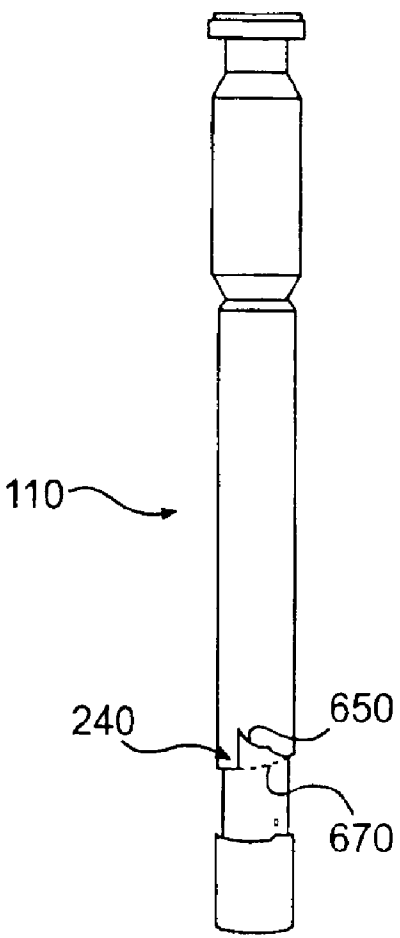
FIGS. 6A and 6B illustrate exemplary plungers according to embodiments of the present invention.
Figure 6A:
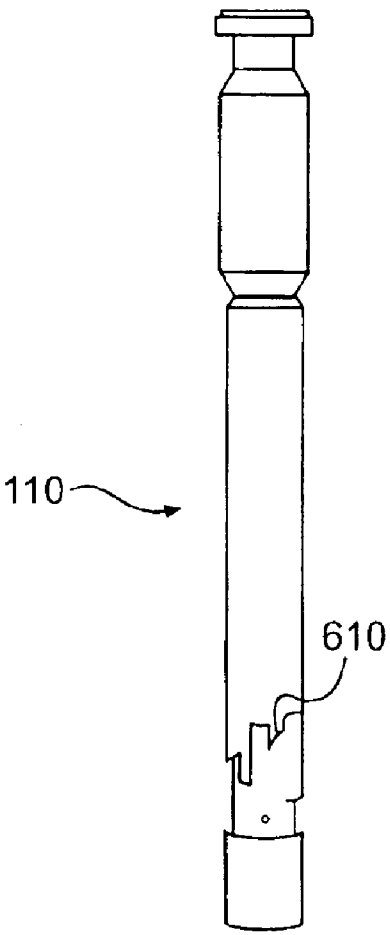

FIG. 6A illustrates a plunger 110 with an upper helix 610 according to an embodiment of the present invention. Upper helix 610 may optimize injection timing for an engine that includes plunger 110. As shown, upper helix 610 somewhat resembles a staircase. The specific form of upper helix 610 may depend on emissions data and/or empirical engine performance testing, as described above. In some embodiments, transitions in steps may be related to transitions in discrete throttle settings. For instance, for certain embodiments, the width of certain steps may span about 25° of the circumference of plunger 110. Height of the various steps may vary.

In other embodiments, it may be desirable to optimize injection timing at higher throttle settings. For example, in a line-haul locomotive, which travels at high speeds much of the time, much of the EPA weighted emissions duty cycle is associated with high notches. Accordingly, for engines in such locomotives and engines in other analogous contexts, the upper helix of a plunger may be modified, for example, such that injection timing is optimized for high notches. FIG. 6B illustrates an exemplary embodiment of a plunger 110 that includes an upper helix 650 and a reference helix 670. Upper helix 650 may reduce emissions for higher notches as compared with reference helix 670. In another exemplary embodiment (not shown), the helix angle of an upper helix may not substantially change or may change only slightly (resembling a straight line, for example) at lower notches, and then may change more substantially at higher notches to optimize injection timing at those notches.

Figure 7:
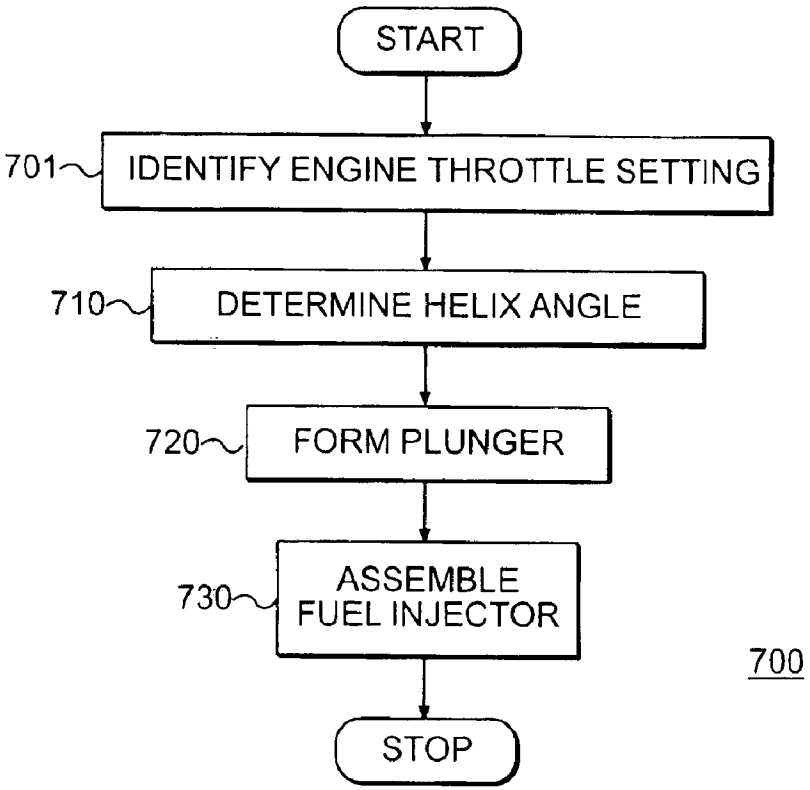
FIG. 7 illustrates a process according to an embodiment of the present invention.

FIG. 7 illustrates a manufacturing process 700 according to an embodiment of the present invention. In task 701, an engine throttle setting in need of optimized injection timing is identified. In task 710, a helix angle capable of optimizing injection timing for the identified engine throttle setting is determined. The determined helix angle may advance, retard, or not alter injection timing. In task 720, a plunger for a fuel injector is formed. An upper helix of the plunger may include at least two segmented portions between points on the plunger respectively corresponding to a first and second throttle position. The segmented portions have unequal associated helix angles. One of the segmented portions may correspond to the throttle setting identified in task 701 and may have an associated helix angle substantially equal to the helix angle determined in task 710. In task 730, a fuel injector that includes the plunger is assembled. The fuel injector may include a through-hardened chromium hot-work steel nozzle tip such as that described above.

In some embodiments, a machining device, such as a programmable device, may be employed to manufacture the plunger. For instance, a plunger with an upper helix having multiple unequal helix angles may be formed from scratch. Alternatively, an existing plunger, such as a plunger whose upper helix has substantially one helix angle, may be modified, such that the modified plunger has an upper helix having multiple unequal helix angles at desired positions of the plunger.

It should be appreciated that when configuring the slope of the upper helix (the timing helix), this may affect the total volume of the fuel chamber defined between the upper helix and the lower helix. Because it may be desirable to maintain the same amount of fuel injected per stroke, it may thus also be desirable to alter the position or configuration of the lower helix in order to maintain the same volume of fuel injected per stroke for such plunger with the modified upper helix. In other words, when manufacturing a plunger for a particular engine that utilizes a preexisting or reference plunger having a reference upper helix and a reference lower helix which define the volume of fuel to be injected at each notch, when replacing such plunger with a plunger manufactured in accordance with the present invention in order to improve on emission characteristics of the engine by modifying the slope of the upper or injection timing helix, it may also be desirable to alter the lower helix to ensure that the total volume of fuel injected per stroke is not changed in comparison with the original plunger having the original reference helices. This may be accomplished, for example, by adding or subtracting material in the region of the lower helix, preferably without changing the slope of the lower helix, (i.e., either moving the lower helix towards or away from the upper helix without changing the slope of the lower helix).

It should also be appreciated that the timing, as determined by the configuration of the upper helix, can be customized in accordance with the present invention to address difference types of emissions or contaminates. For example, as the present invention may relate to the railroad industry, there is a particular desire to reduce the amount of NOx emissions (nitrogen oxide and nitrogen dioxide emissions). It is known that for NOx, the emissions thereof is directly related to combustion temperature. Specifically, as combustion temperature goes down, NOx emissions goes down. As combustion temperature goes up, NOx emissions goes up. By retarding the timing or onset of combustion by changing the configuration of the upper helix at a particular notch in relation to a reference or prior art plunger, this will reduce the combustion temperature and hence reduce NOx emissions. Specifically, changing the upper helix slope to retard the timing of combustion will cause the combustion to be delayed, resulting in an insufficient amount of combustion time for the fuel to bum completely and hence reducing the temperature that is reached. It should be appreciated, however, that because the fuel does not bum completely, combustion efficiency and fuel efficiency will go down in comparison with the reference plunger for those notches in which the timing has been retarded in comparison with the reference plunger. It has been found, however, that the fuel penalty (i.e., the increase in inefficiency of fuel bum) can be engineered to be sufficiently low such that the benefit or degree of reduction in NOx emissions far out weighs any percentage increase in fuel bum. In one embodiment of the present invention, a desired weighted NOx emissions is predetermined, and the upper or timing helix is cut or angled in a manner that achieves that desired level of emissions while simultaneously obtaining the best fuel efficiency for that emissions level. For example, in the event that a particular maximum emissions level is desired (e.g., as a maximum threshold that might be set by the Environmental Protection Agency for a particular type of engine) as measured in grams/BHP-HR.

In accordance with one aspect of the present invention, the emissions at each throttle position is measured to determine the throttle position or range of positions that are most detrimental to emissions. By retarding the timing to reduce NOx emissions, for example, at the most critical throttle positions (or notches in the case of a locomotive engine) a significant benefit to the total weighted emissions can be achieved with a relatively insignificant impact on fuel efficiency. Specifically, by retarding the timing at the throttle position(s) that have the greatest impact on emissions output, a significant reduction in emissions can be achieved with the least fuel penalty. It should be appreciated that in the case of NOx emissions, as the emissions are decreased, fuel efficiency is likewise decreased. However, it is one aspect of the invention to achieve a desired weighted NOx emissions output while minimizing the fuel penalty, and achieving this by retarding the timing of fuel injection at the more critical throttle position or positions.

It should also be appreciated that while increasing combustion temperature may increase NOx emissions, it may also reduce other types of emissions such as hydrocarbons and particulates. Therefore, in some applications, it may be desirable to focus efforts on other types of emissions such that the timing might be advanced in respect to a prior art or reference plunger to reduce emissions of such type. In that case, rather than balancing emissions against fuel efficiency, it may instead be desirable to balance one type of emissions versus another type of emissions. For example, it may be desirable to reduce hydrocarbon and particulate emissions and setting a desired maximum threshold for such emissions, and then customizing or altering the timing angle to achieve a minimalized increase in any NOx emissions that may be associated with the improvement of the particulate or hydrocarbon emissions resulting from the advanced timing.

Figure 8:
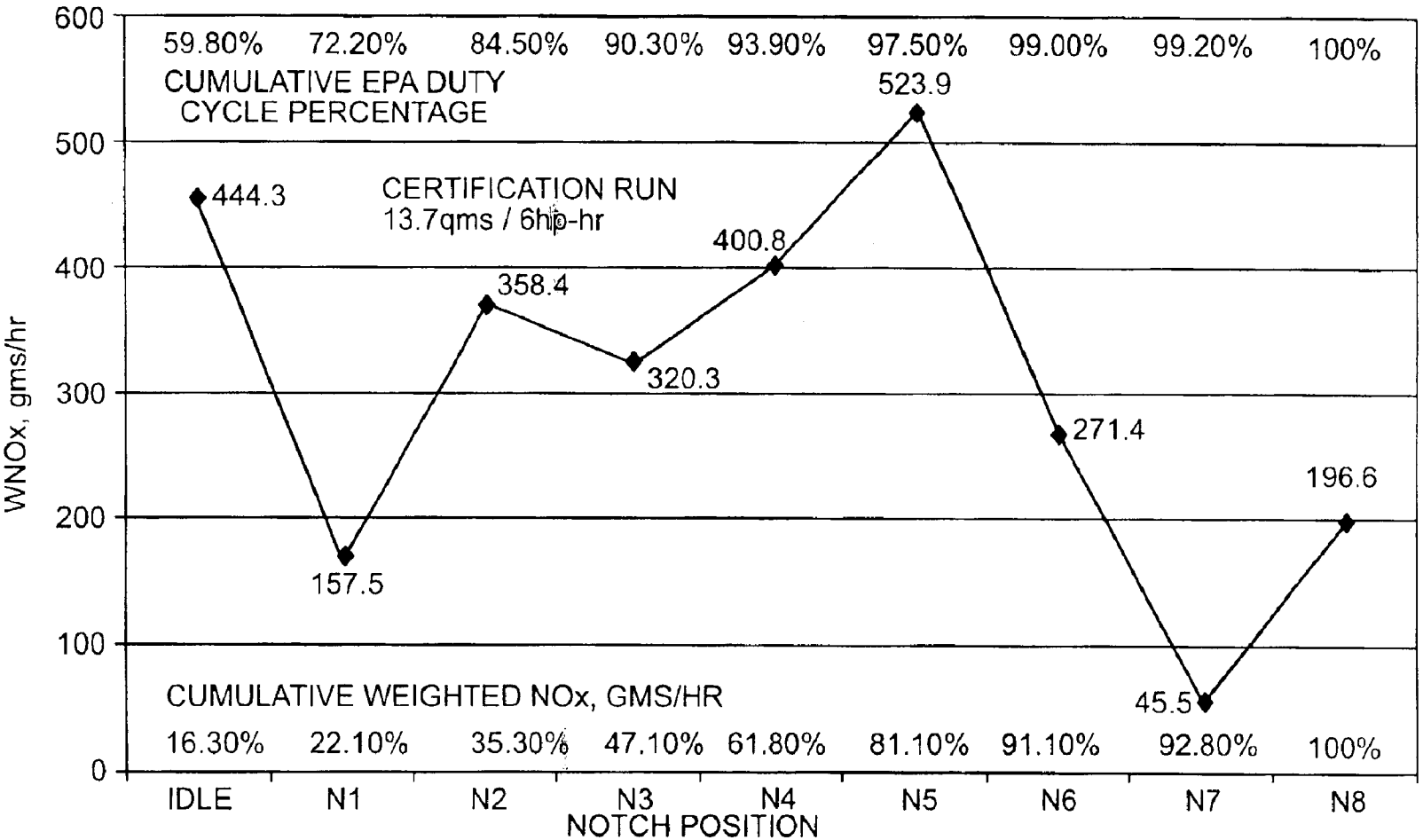
FIG. 8 PRIOR ART
FIG. 8 is a graph illustrating NOx emissions profile in gms/hr for a switcher-type locomotive engine employing a prior art unit injector.
Figure 9:
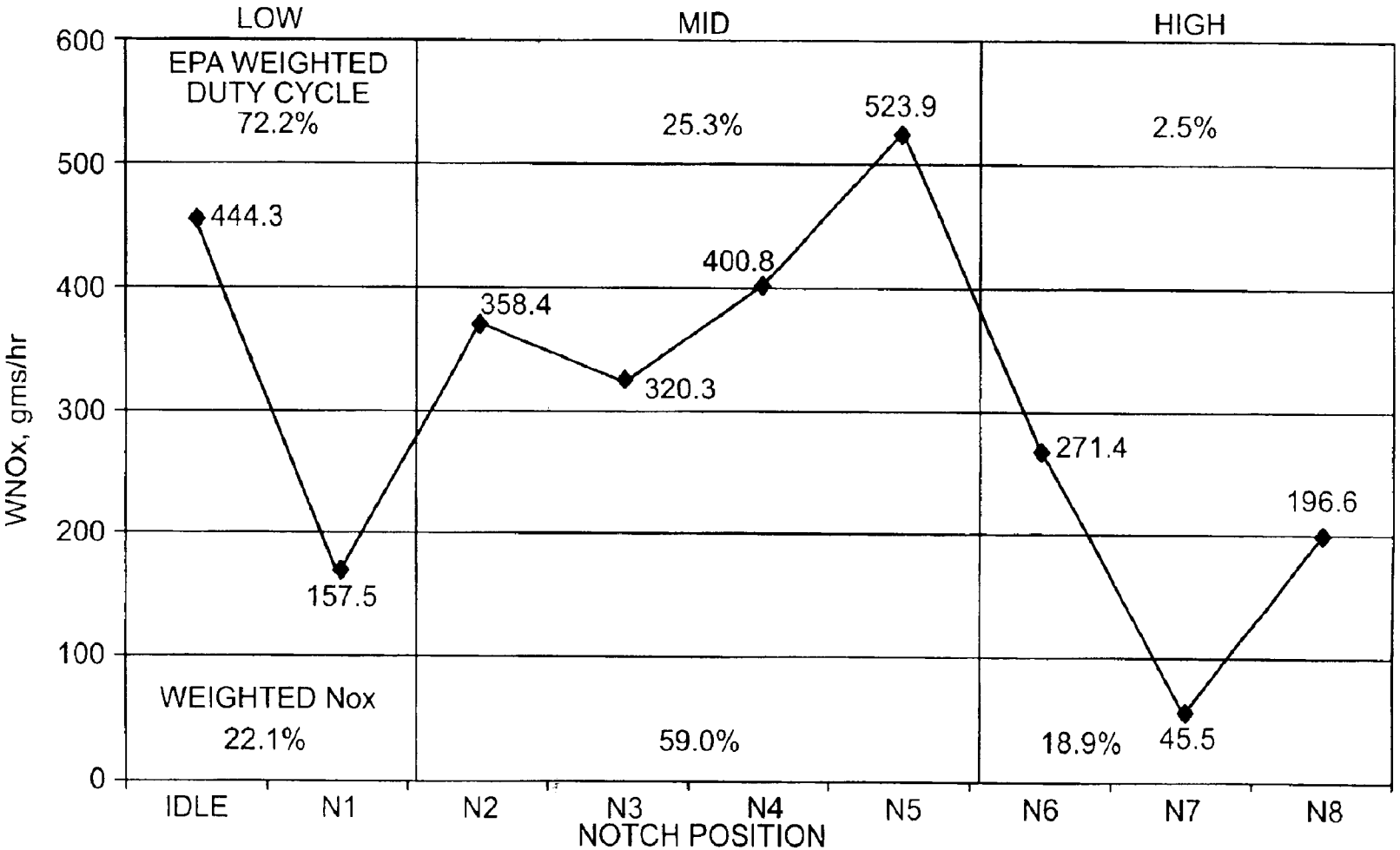
FIG. 9 PRIOR ART
FIG. 9 is another representation of the graph shown in FIG. 8.

FIG. 8 illustrates the NOx emissions profile in grams per hour plotted against notch position for a switcher-type locomotive engine. The locomotive used was GP38-2 and the engine used was General Motors EMD (Model 16-645E). The engine utilizes a conventional prior art unit fuel injector having a standard, single slope timing helix. As shown towards the top of the graph, the EPA has conducted tests to determine the duty cycle of operation for a standard switcher-type locomotive at each notch position. For example, the EPA has determined that an engine of this type runs 59.8% of the time in the idle position, 12.4% of the time at notch 1, 12.3% of the time at notch 2, 5.8% of the time at notch 3, 3.6% of the time in notch 4, 3.6% of the time at notch 5, 1.5% of the time at notch 6, 0.2% of the time at notch 7, and 0.8% of the time at notch 8. The cumulative duty cycle numbers are illustrated in the chart. Also, illustrated towards the bottom of the chart is the cumulative weighted NOx in grams per hour, taken as a percentage. For example, as illustrated, 81.10% of the cumulated weighted NOx emissions takes place at notches N5 and below. As illustrated in FIG. 9, which is another representation of FIG. 8, 72.2% of the EPA weighted duty cycle resides in the idle and N1 notches, although this constitutes only 22.1% of the weighted NOx emissions. Notches N2–N5 represent 25.3% of the EPA weighted engine duty cycle, and constitute 59.0% of weighted NOx emissions. Finally, notches N6–N8 represent only 2.5% of the weighted duty cycle as determined by the EPA, and 18.9% of the weighted NOx emissions. As can be appreciated, the NOx emissions associated with notch 5 at 523.9 grams per hour as a weighted number is the highest on a chart. The inventors have determined that because 81.1% of accumulative weighted NOx emissions and grams per hour reside in notches N5 and below, it would be advantageous to reduce NOx emissions at those levels by retarding the timing at notches N5 and below to achieve the desired net total NOx emissions in grams per BHP-hour of 14.0.

In accordance with the method contemplated herein, the timing may be retarded at at least one notch level (if not more) to achieve the reduction in NOx emissions as desired, while minimizing the fuel penalty associated with achieving that level of NOx emissions. In one aspect of the invention, the degree of retardation at the one or more throttle or notch positions may be established by trial and error after determining which notch positions are most critical in relation to NOx emissions. For example, once the data of FIG. 9 is established, it becomes readily apparent that retarding the timing at notch 5 and perhaps notches below that level is particularly desirable. The extent to which each of the notches has its timing retarded in relation to the original reference plunger is one that may be established experimentally through trial and error. Alternatively complex algorithmic formula and software may be developed to derive the optimal level of retardation or advancement (if any) to achieve a desired emissions output with a minimized fuel penalty.

Figure 10:
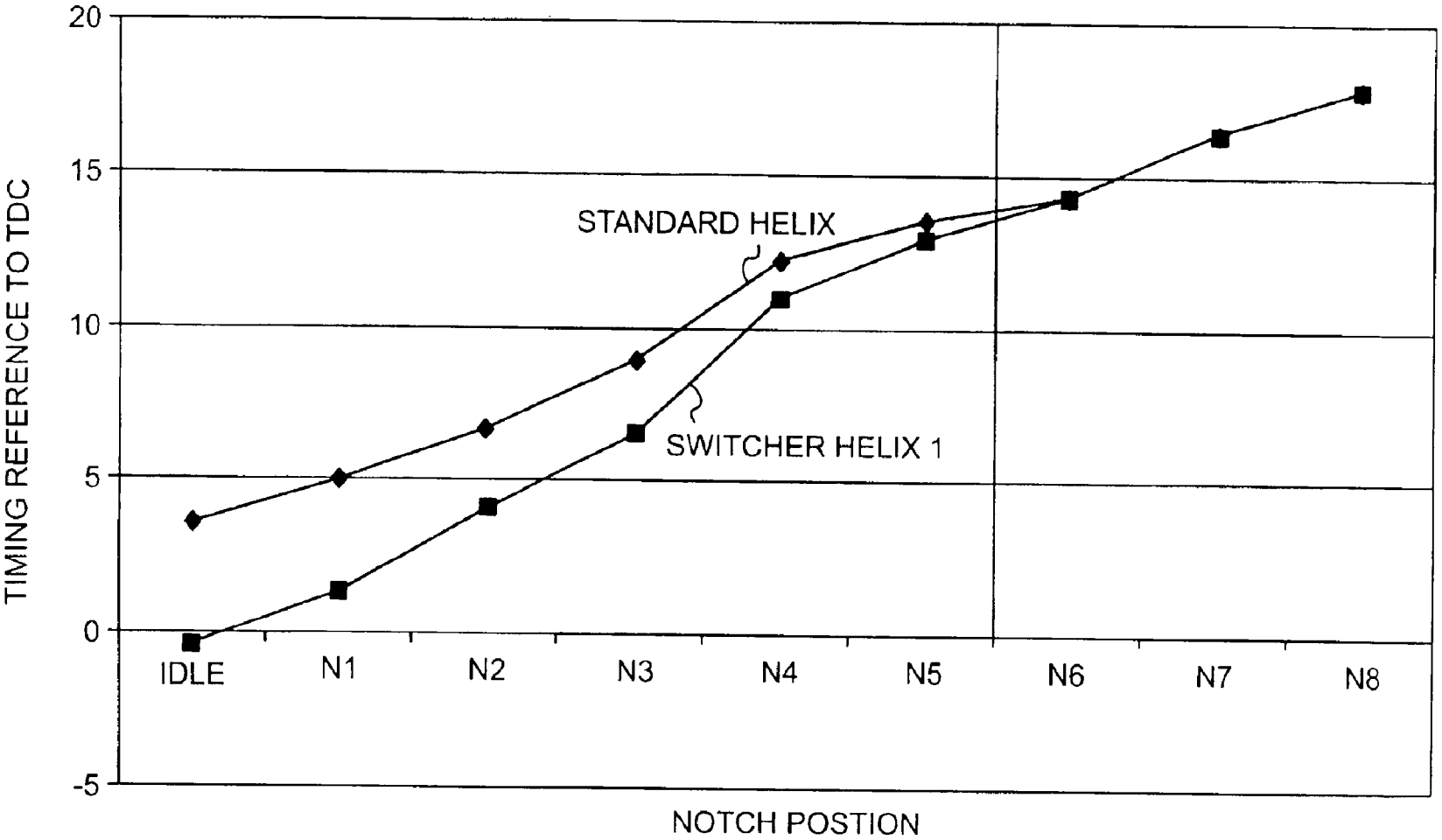
FIG. 10 is a graph illustrating an experiment that compares a switcher helix (switcher helix 1) and a standard helix for a switcher engine that had the timing thereof retarded for notches N5 down through the idle positions.
Figure 11:
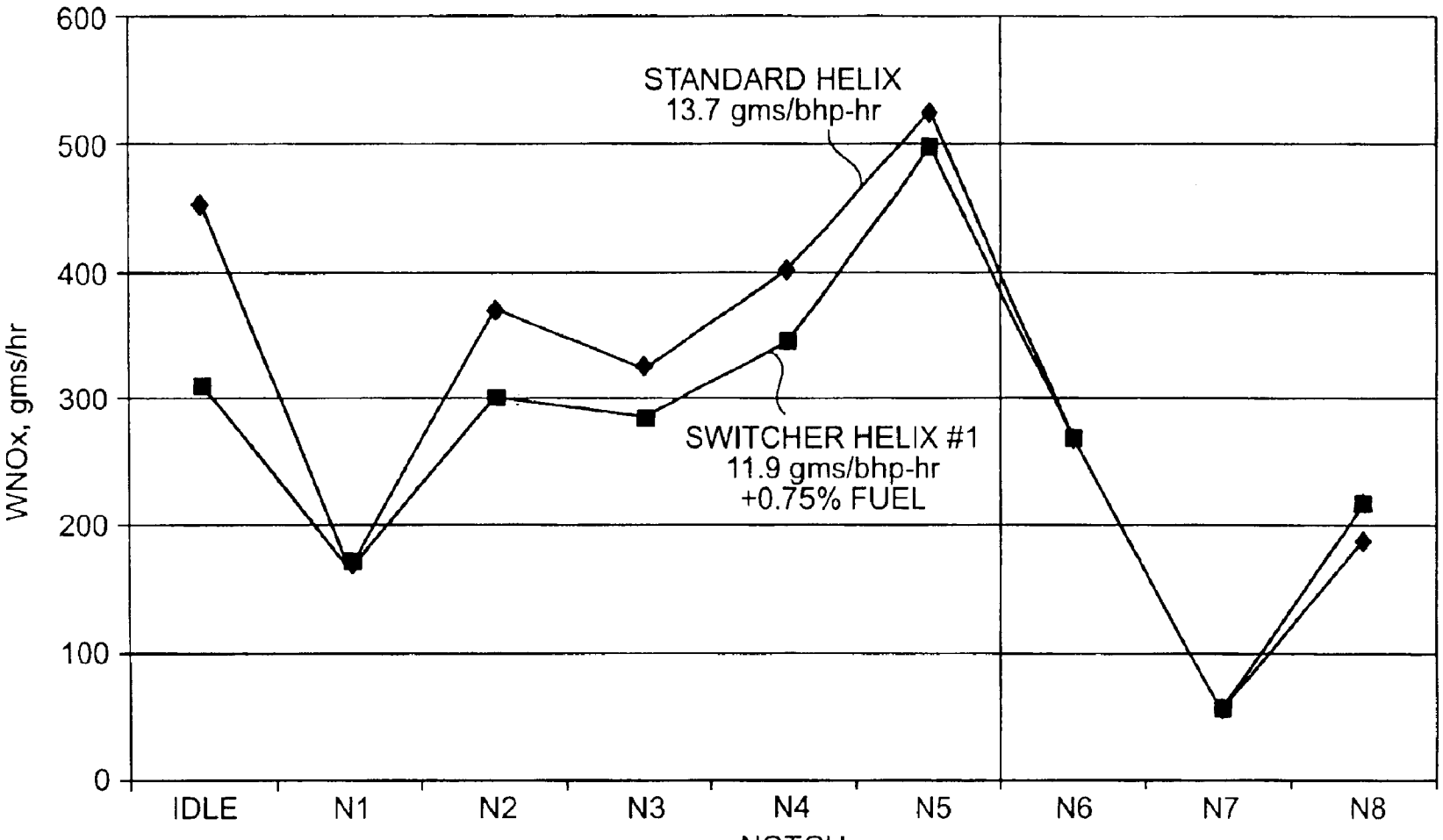
FIG. 11 is a graph illustrating NOx emissions profile for the experiment shown in FIG. 10.

FIG. 10 illustrates a comparison of a plunger employing a standard or reference helix (prior art) for a switcher engine versus a plunger sample ("Switcher Helix #1") having a modified slope in comparison with a standard helix for that engine such that the timing thereof was retarded for notches N5 down through the idle positions. The amount of retardation at each notch is compared to the standard timing and is illustrated by reference to the timing in degrees relative to top dead center. As illustrated in FIG. 11, this retardation in the timing illustrated in FIG. 10 resulted in a total reduction of 1.8 grams/BHP-HR in comparison with the standard or reference helix. That is, the weighted NOx emissions was reduced from 13.7 grams/bhp-hour to 11.9 grams of NOx/bhp-hour. In addition, this was achieved with only a 0.75% fuel penalty (i.e., a 0.75% decrease in combustion efficiency.)

Figure 12:
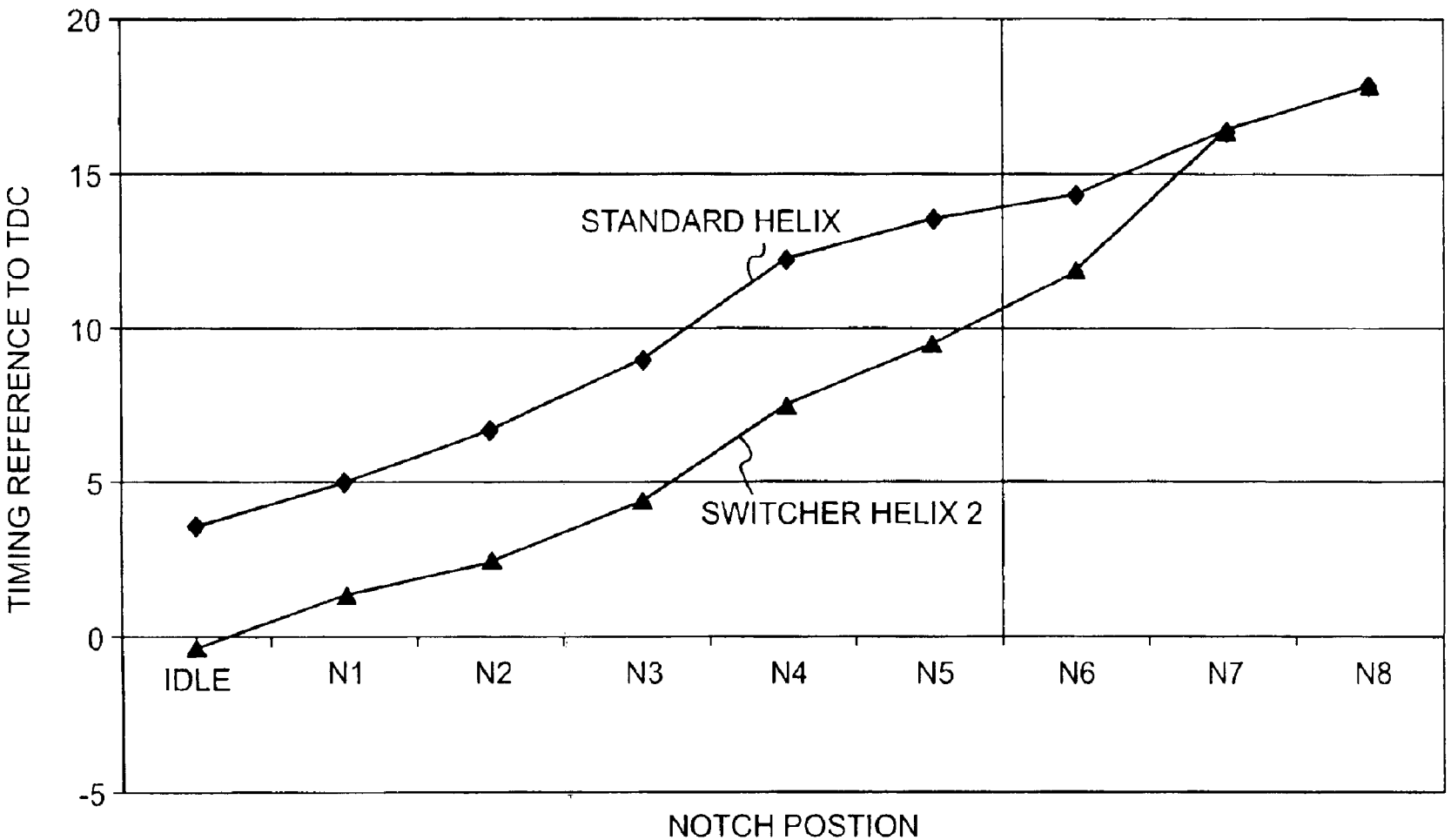
FIG. 12 is a graph illustrating an experiment that compares another switcher helix (switcher helix 2) and a standard helix for a switcher engine that had the timing thereof retarded for notches N6 down through the idle positions.
Figure 13:
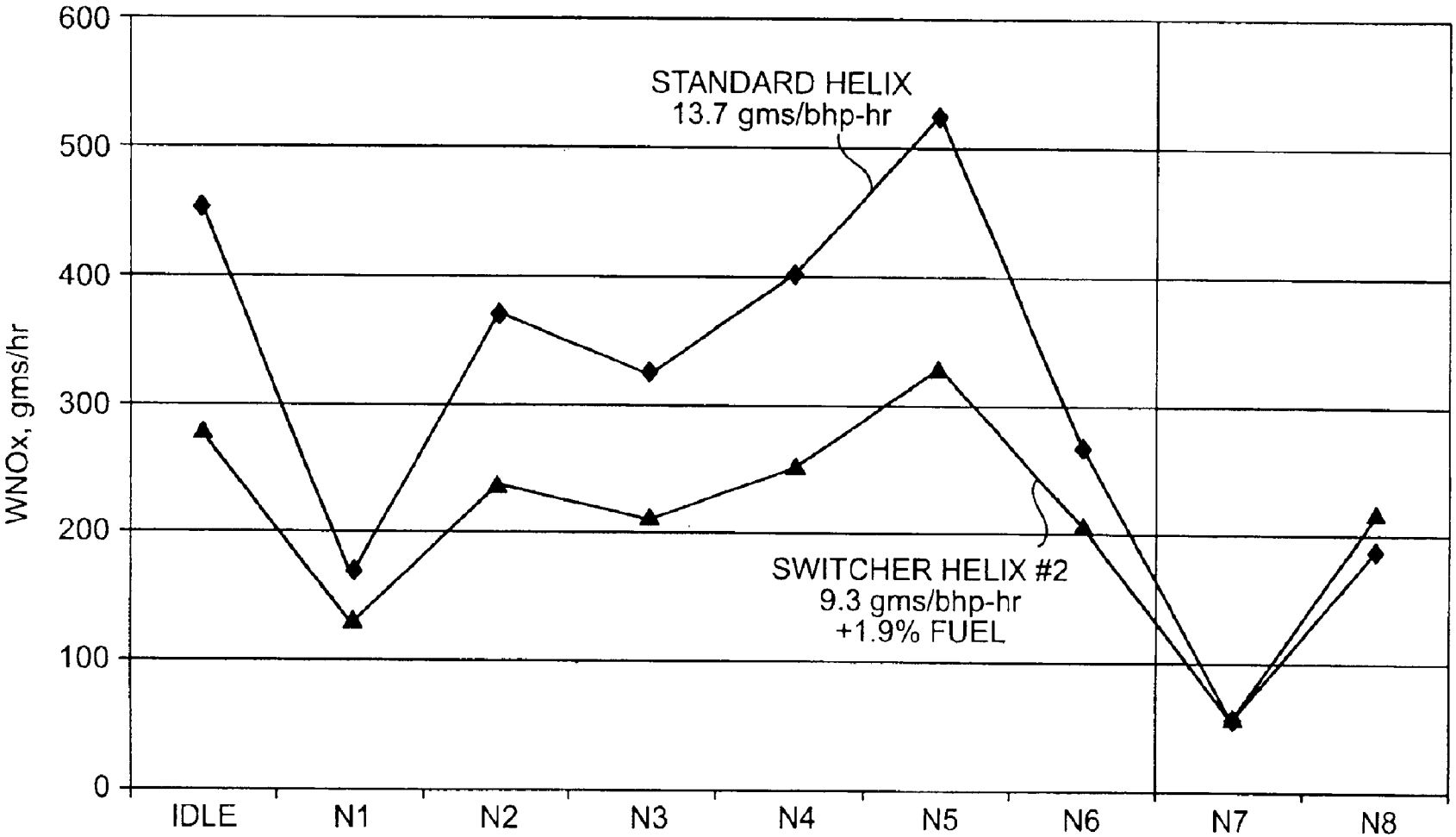
FIG. 13 is a graph illustrating NOx emissions profile for the experiment shown in FIG. 12.

FIG. 12 illustrates the test results using the same engine, but with another plunger (Switcher Helix 2) in which the timing was retarded for notches N6 and below, and a comparison with the standard or reference helix. As illustrated in FIG. 13, this resulted in a reduction of weighted NOx from 13.7 grams/BHP-hour to 9.3 grams/BHP-hour, for a reduction of 4.4 grams/BHP-hour. However, this was achieved at a 1.9% fuel penalty.

Figure 14:
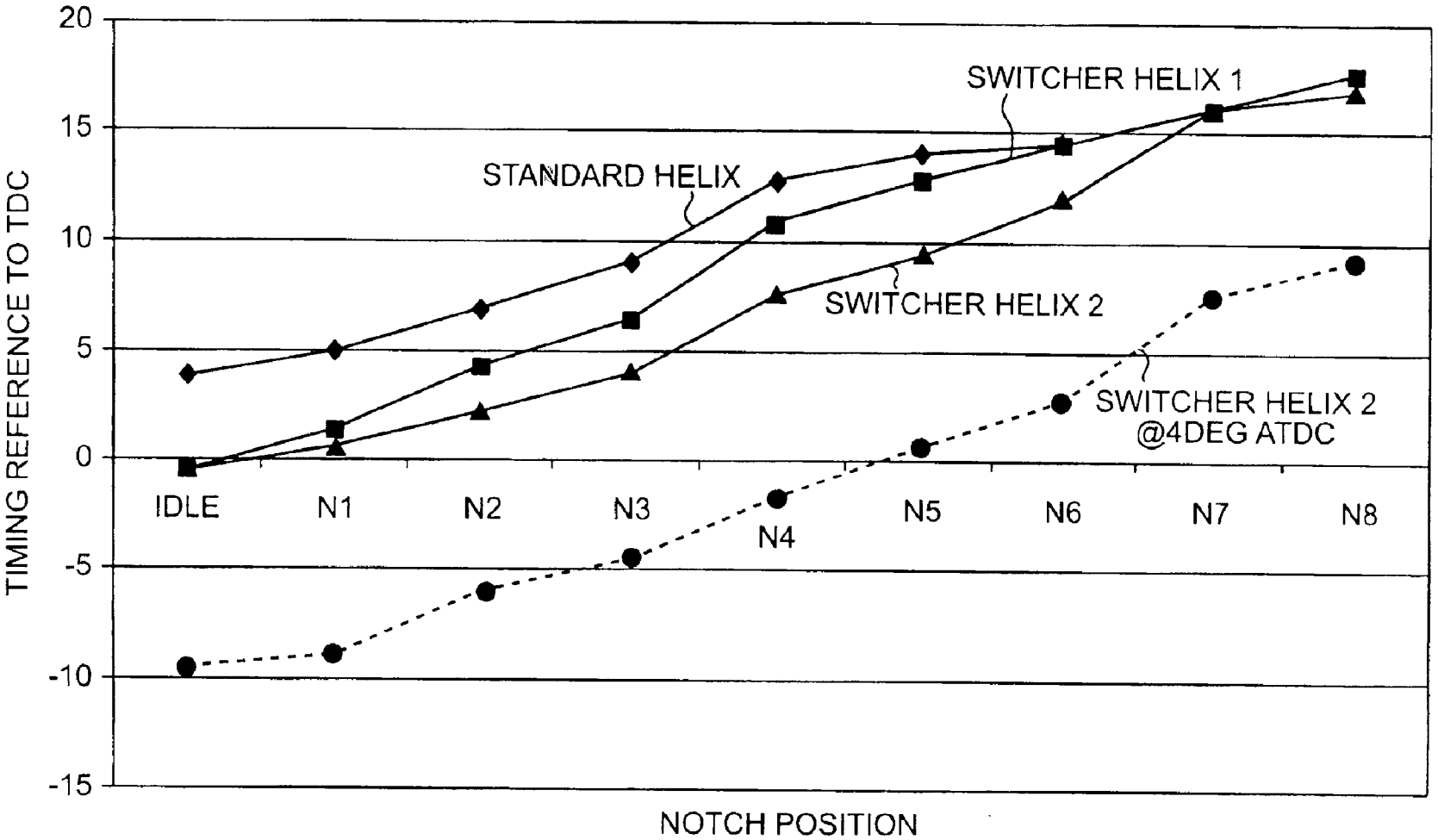
FIG. 14 is a graph illustrating an experiment in which a switcher helix (switcher helix 2) was uniformly retarded by changing the fly-wheel pointer position.
Figure 15:
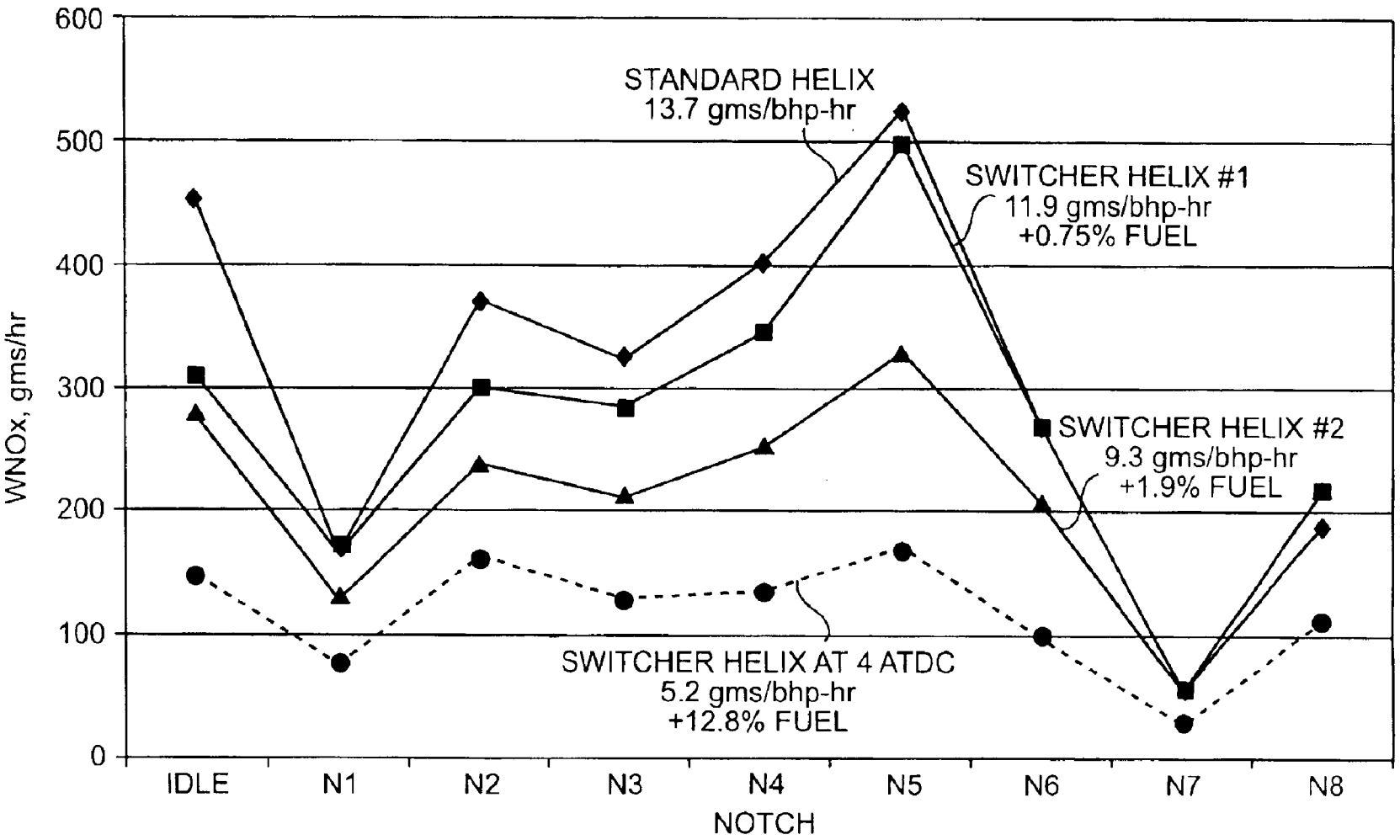
FIG. 15 is a graph illustrating NOx emissions profile for the experiment shown in FIG. 14.

FIG. 14 illustrates an experiment that was conducted in order to determine what would happen if the timing for switcher helix 2 was uniformly retarded by changing the fly-wheel pointer position. This was conducted at four degrees after top dead center. As illustrated in FIG. 15, this resulted in an undesirable fuel penalty of 12.8%.

Figure 16:
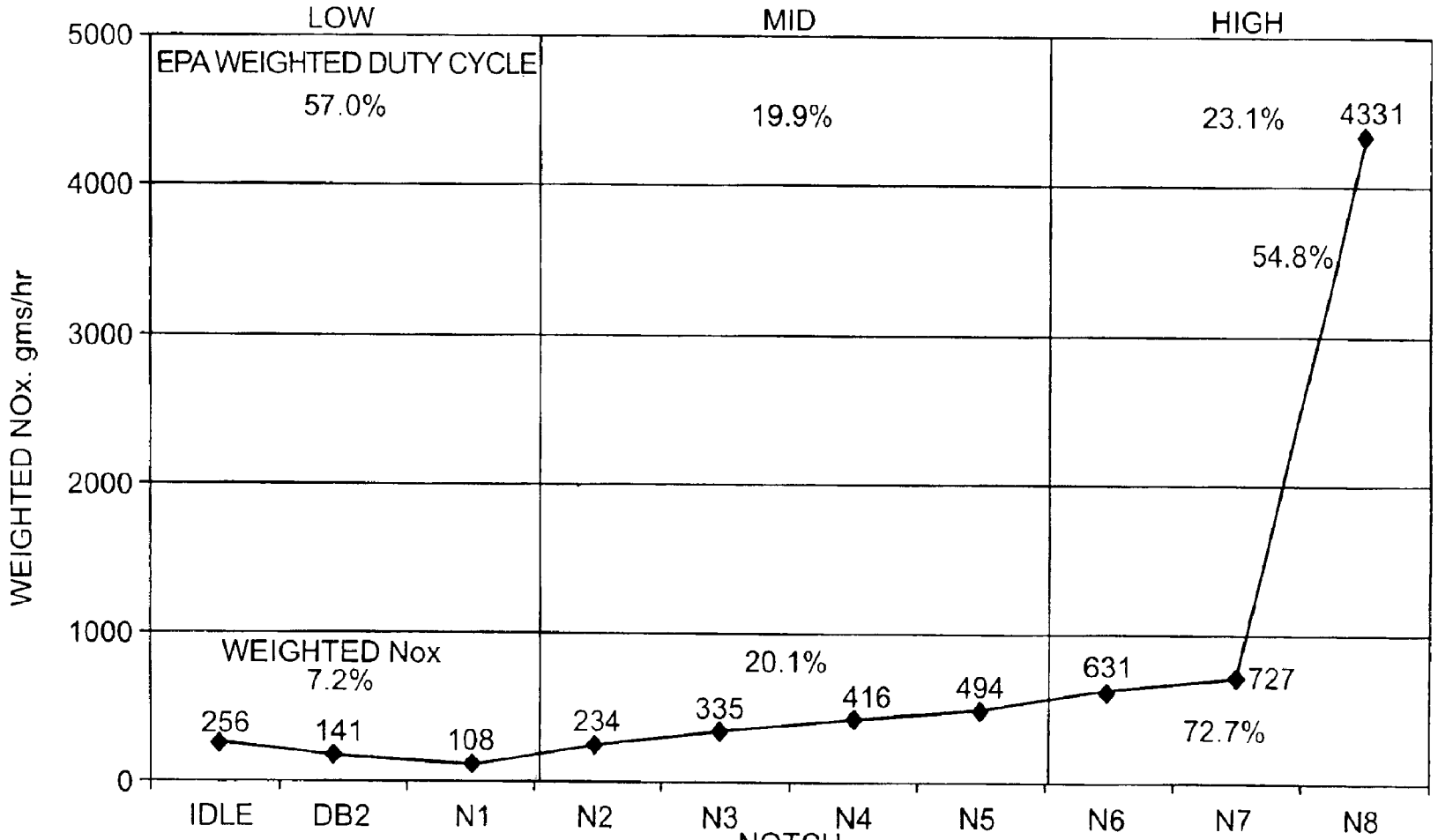
FIG. 16 PRIOR ART
FIG. 16 is a graph illustrating NOx emissions profile in gms/hr for a line-haul locomotive engine employing a prior art unit injector.
Figure 17:
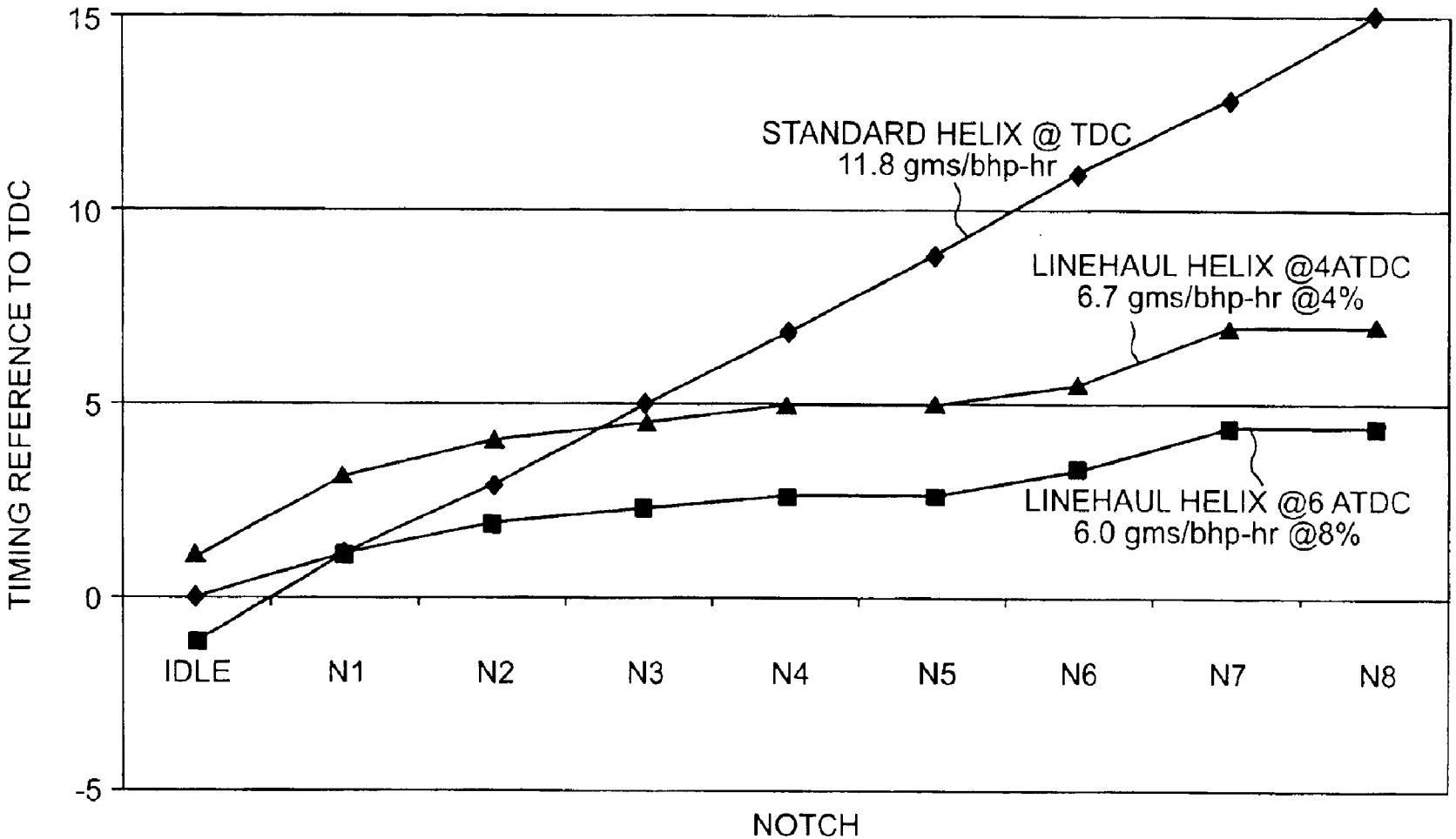
FIG. 17 is a graph illustrating helix performance for a line-haul locomotive engine.
Figure 18:
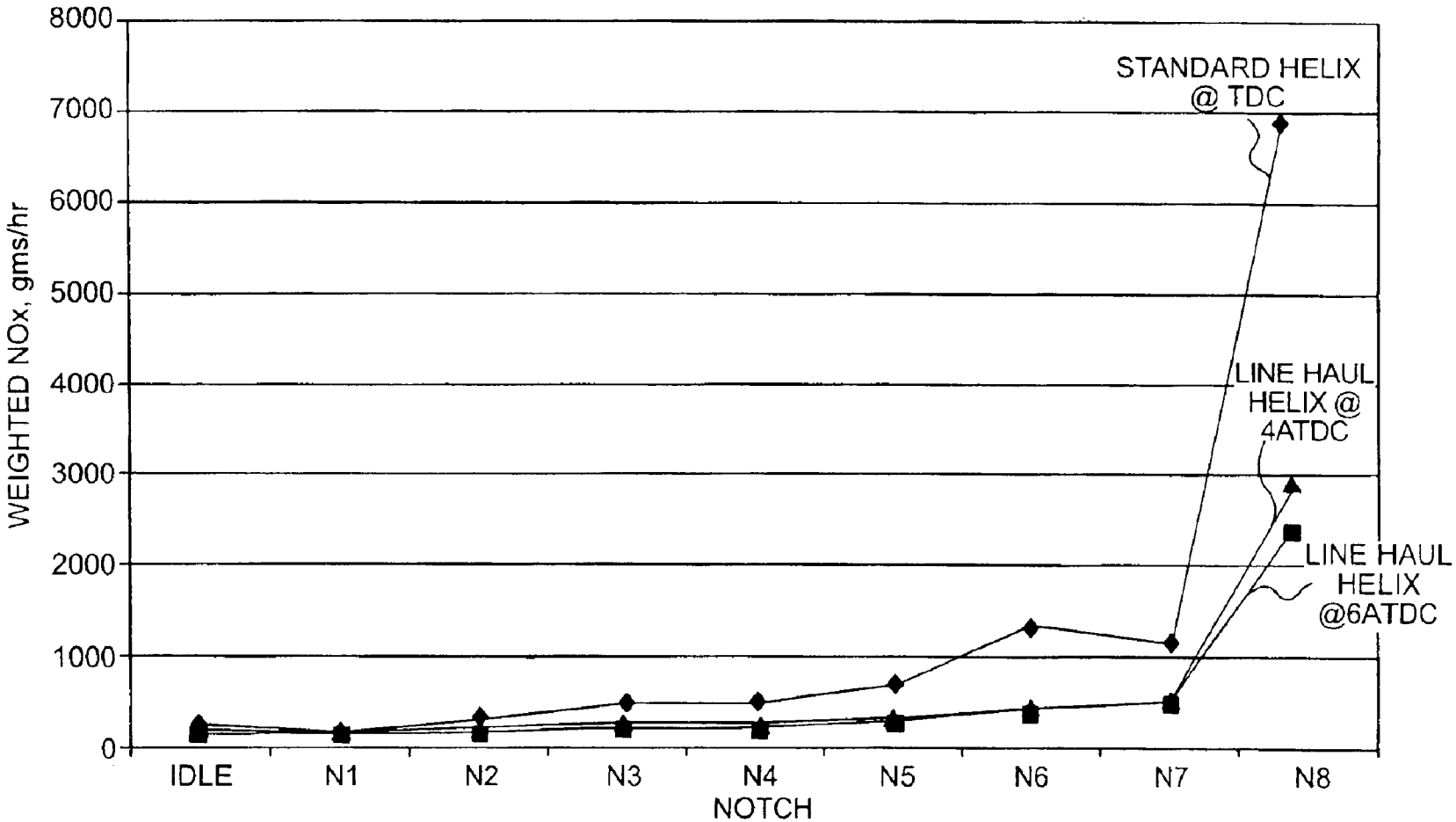
FIG. 18 is a graph illustrating NOx emissions profile in gms/hr for a line-haul locomotive engine.

FIGS. 16–18 illustrate data derived for a different type of engine than the switcher engine discussed above with respect to FIGS. 8–15. Specifically, FIGS. 16–18 relate to a line-haul type engine (General Motors EMD 16-645E3B) used in locomotive model SD40-2. As illustrated in FIG. 16, notch 8 represents a significantly high percentage of the total weighted NOx emissions when using the reference prior art plunger. Accordingly, it would be desirable to significantly retard the timing at notch 8 to improve NOx efficiency. As illustrated in FIG. 17, in one embodiment the line hall helix at 4 degrees after top dead center had its slope modified relative to the standard helix for that engine by having the slope altered so that the timing is substantially retarded at notches N8–N3 in comparison with the standard helix. However, at notches N2, N1 and idle, the timing was advanced in order to improve upon fuel efficiency at these lower notch levels since the retarded timing at the higher notches, e.g. notch 8 significantly improves upon the emissions characteristics at the higher level, thus enabling some room for improved fuel efficiencies at the lower notch levels to improve upon fuel economies in those lower notches so that the resulting weighted NOx level resulted in 6.7 grams/BHP-HR, with a 4% fuel penalty. Results are also shown where at 6 degrees after top dead center the timing was modified, and resulted in NOx level of 6.0 grams/BHP-HR, with an 8% fuel penalty. FIG. 18 illustrates NOx emissions with line-haul helixes at 4 and 6 degrees after top dead center in comparison with the standard helix. As illustrated, the total weighted NOx emissions at the higher notches (N6, N7, N8) was substantially reduced, especially N8, when line-haul helixes were used.

It will be appreciated by those skilled in the art that the term "helix" or "helices" do not necessarily refer to a timing ridge of what is in fact a helix or of a helical shape. Specifically, heretofore the upper timing line or ridge that has been formed in injector plungers have been helical in shape and have thus been referred to as the "upper timing helix" or the like. It can be appreciated, however, that in accordance with the present invention, the upper timing structure formed in the plunger need not at all be shaped as a helix, as can be appreciated, for example, from the shape of the timing structures or helixes 330, 610, 650, etc. Thus, the term "helix" should refer broadly to the upper timing structure formed on the plunger.

The foregoing description of embodiments is provided to enable any person skilled in the art to make or use embodiments of the present invention. Various modifications to these embodiments are possible, and the generic principles presented herein may be applied to other embodiments as well. For instance, embodiments herein may be applied in conjunction with other apparatus and methods, such as other technologies for reducing engine emissions and/or improving engine performance.

It is to be appreciated that the specific form of the upper and lower helices of a plunger may be varied in any of a multitude of ways consistent with the teachings of the present application. Helix angles may be varied to achieve desired performance criteria for particular implementations.

As such, the present invention is not intended to be limited to the embodiments shown above but rather is to be accorded the widest scope consistent with the principles and novel features disclosed in any fashion herein.

What is claimed is:

1. A method for manufacturing an emissions-efficient plunger for a fuel injection mechanism for a combustion engine, comprising:

obtaining emissions data for said combustion engine at different throttle positions while using an injection mechanism with a reference plunger having a reference helix, said reference helix having a reference helix angle, said reference helix angle defining an injection timing;

determining, based on said emissions data, optimal helix angles at least at a first and a second throttle position within said throttle positions, said optimal helix angle at said first throttle position being different from said optimal helix angle at said second throttle position; and forming an optimal plunger that includes said optimal helix angles.

2. A method according to claim 1, wherein said first throttle position is at a lower throttle position than said second throttle position, and wherein said forming comprises altering the optimal helix angle at said lower throttle position so that the injection timing is retarded in comparison with that for said reference helix.

3. A fuel injector for an engine fuel system, said engine fuel system having a plurality of throttle positions, each of said throttle positions having corresponding emissions characteristics, said fuel injector comprising:

an injector body;

a plunger within said body, said plunger having an upper helix ridge and a lower helix ridge, the helix ridges defining a channel and determining opening and closing of fuel ports of the injector;

the upper helix ridge having a ridge portion sloping from a first point on the plunger surface towards a second point on the plunger surface, the first point being associated with an idle throttle position, the second point being associated with a full throttle position, said ridge portion including at least two segmented portions between the first and second points, the at least two segmented portions corresponding to associated throttle positions between said idle and full throttle positions, said at least two segmented portions having unequal associated helix angles, said unequal helix angles of the at least two segmented portions being angled in accordance with emissions characteristics of the engine at the associated throttle positions.

4. A fuel injector for an internal combustion engine, comprising:

a housing defining a cylindrical chamber having a longitudinal axis and axially-spaced first and second fuel ports communicating therewith each of which is communicated with a source of fuel under low pressure;

a plunger mounted in said chamber for reciprocating axial movement through successive operative cycles, each including a pump stroke and a return stroke in timed relation to the repetitive cycles of said engine, a fuel injection nozzle constructed and arranged to inject a fuel charge into an engine cylinder during each pump stroke of said plunger;

said fuel injection nozzle being communicated with a pump portion of said cylindrical chamber defined by a free end of said plunger, said plunger having an annular axially extending peripheral chamber defined by first and second annular ridges and openings communicating said peripheral chamber with the pump portion of said cylindrical chamber, the arrangement being such that fuel within the pump portion of said cylindrical chamber communicating with said nozzle will be pressurized to effect injection only during each reciprocating cycle of said plunger when said first and second fuel ports are closed by said plunger and the end portion of said plunger is moving through the pump stroke thereof, said plunger being mounted for controlled rotational movement within said cylindrical chamber in accordance with a desired operating energy level of said engine between a notched range from idle to full throttle, the axial position of said second ridge spaced apart from said second fuel port progressively increasing for each notch position from idle to full throttle at the time of the closing of said first fuel port thereby increasing the amount of fuel injected and energy level of the engine;

the axial position of said first ridge on said plunger when moved into closed relation to said first fuel port during each pump stroke at any particular notch determining the commencement of fuel injection in relation to the top dead center position of a piston of the engine cylinder within which injection occurs, the axial position of said first ridge through the notched range being divided into a plurality of sections including a low section relating to the lower branches having a configuration which balances fuel efficiency and $NO_x$ emissions in favor of low $NO_x$ emissions and a high section relating to the higher notches having a configuration which balances fuel efficiency and $NO_x$ emissions in favor of high fuel efficiency.

* * * * *